US007375708B2

(12) United States Patent
Kubota et al.

(10) Patent No.: US 7,375,708 B2
(45) Date of Patent: May 20, 2008

(54) IMAGE DISPLAY PANEL, IMAGE DISPLAY APPARATUS AND IMAGE DISPLAY METHOD

(75) Inventors: Yasushi Kubota, Sakurai (JP); Hajime Washio, Tenri (JP); Shigeto Yoshida, Nabari (JP); Yasuhiro Yoshida, Nara (JP); Hiroyuki Furukawa, Ueno (JP)

(73) Assignee: Sharp Kabushiki Kaisha, Osaka (JP)

( * ) Notice: Subject to any disclaimer, the term of this patent is extended or adjusted under 35 U.S.C. 154(b) by 198 days.

(21) Appl. No.: 10/105,652

(22) Filed: Mar. 25, 2002

(65) Prior Publication Data

US 2002/0149606 A1 Oct. 17, 2002

(30) Foreign Application Priority Data

Apr. 16, 2001 (JP) ..... 2001-117453

(51) Int. Cl.
*G09G 3/36* (2006.01)

(52) U.S. Cl. ..... 345/89; 345/213

(58) Field of Classification Search ..... 345/87–100, 345/204–205, 211–213; 349/157, 140
See application file for complete search history.

(56) References Cited

U.S. PATENT DOCUMENTS 4,899,216 A * 2/1990 Tatsumi et al. ..... 358/521
5,649,031 A * 7/1997 Nakamura et al. ..... 382/254
5,903,014 A * 5/1999 Ino et al. ..... 257/66
5,956,156 A * 9/1999 Fukushima ..... 358/447
6,008,793 A * 12/1999 Shigeta ..... 345/204
6,091,398 A * 7/2000 Shigeta ..... 345/204
6,326,941 B1 * 12/2001 Yamazaki et al. ..... 345/95
6,369,782 B2 * 4/2002 Shigeta ..... 345/63
6,587,088 B2 * 7/2003 Kasai et al. ..... 345/89
6,606,099 B2 * 8/2003 Yamada ..... 345/690
6,693,616 B2 * 2/2004 Koyama et al. ..... 345/98
2001/0026283 A1 10/2001 Yoshida

FOREIGN PATENT DOCUMENTS

JP 06-082754 3/1994

(Continued)

OTHER PUBLICATIONS

U.S. Appl. No. 09/426,165, Oct. 22, 1999, S. Daly.

*Primary Examiner*—Richard Hjerpe
*Assistant Examiner*—Kimnhung Nguyen
(74) *Attorney, Agent, or Firm*—David G. Conlin; Peter J. Manus; Edwards Angell Palmer & Dodge LLP

(57) ABSTRACT

A data signal line drive circuit supplying a video signal to a pixel array performs pseudo tone gradation processing with respect to the video signal that is sent to an n number of data signal lines SL by m (<n) stages of a pseudo tone gradation processing section, and outputs the video signal processed by the pseudo tone gradation processing section identical to the data signal lines SL per m lines when sends the video signals subjected to the pseudo tone gradation processing to the data signal lines SL. By doing this, the drive circuit using the pseudo tone gradation processing is given a simple circuit structure, thereby providing an image display apparatus of a driving circuit integrated type in which the pixel array and the drive circuit are formed on a substrate.

59 Claims, 26 Drawing Sheets

FOREIGN PATENT DOCUMENTS

| | | |
|---|---|---|
| JP | 07-219493 | 8/1995 |
| JP | 09-050262 | 2/1997 |
| JP | 09-185707 | 7/1997 |
| JP | 11-003068 | 1/1999 |
| JP | 11-095251 | 4/1999 |
| JP | 11-153981 | 6/1999 |

* cited by examiner

IMAGE DISPLAY PANEL, IMAGE DISPLAY APPARATUS AND IMAGE DISPLAY METHOD

FIELD OF THE INVENTION

The present invention relates to an image display apparatus of a matrix type in which a plurality of scanning signal lines and a plurality of data signal lines are placed so as to make right angles with each other and a pixel is positioned in each intersection section of the both signal lines, especially to an image display apparatus of a drive circuit integrated type in which the pixels and a drive circuit for a wiring are formed on a substrate.

BACKGROUND OF THE INVENTION

As a conventional image display apparatus, a liquid crystal display apparatus of an active matrix driving method is known. This liquid crystal display apparatus is, as shown in FIG. 23, provided with a pixel array (ARY) 101, a scanning signal line drive circuit (GD) 102, a data signal line drive circuit (SD) 103, a timing signal generating circuit (CTL) 104, and a video signal processing circuit (SIG) 105.

The pixel array 101 is provided with a large number of scanning signal lines GL and a large number of data signal lines SL that are crossed with each other, and each intersection of each scanning signal line GL and each data signal line SL is accordingly provided for a pixel (PIX) 106. Namely, each area surrounded with the adjacent two scanning signal lines GL and the adjacent two data signal lines SL is provided with each pixel 106, and the pixels 106 that are arranged in a matrix manner compose a display screen.

The scanning signal line drive circuit 102, synchronizing to a timing signal such as a clock signal GCK inputted from the timing signal generating circuit 104, sequentially selects the scanning signal lines GL and controls opening and closing of a switching element in the pixels 106. By doing this, the scanning signal line drive circuit 102 writes into each pixel 106, video signals (data) that are written into each data signal line SL, and keeps the data that are written into each pixel 106.

The data signal line drive circuit 103, synchronizing to a timing signal such as a clock signal SCK inputted from the timing signal generating circuit 104, samples a video signal DAT inputted from the video signal processing circuit 105, and amplifies the video signal DAT, if necessary, and writes the video signal DAT into each data signal line SL.

As shown in FIG. 24, each pixel 106 in FIG. 23 is composed of a field-effect transistor SW, which is a switching element, and a pixel capacitor (which includes a liquid crystal capacitor CL, and a supplemental capacitor CST, that is added if necessary). In FIG. 24, one electrode of the pixel capacitor is connected to the data signal line SL via a drain and a source of the transistor SW. A gate of the transistor SW is connected to the scanning signal line GL. The other electrode of the pixel capacitor is connected to a common electrode line that is common to all pixels. Then voltage that is applied to each liquid crystal capacitor CL modulates transmittance or reflectance of the liquid crystal, and display is performed by using the modulated transmittance or reflectance.

In addition, a technology has been recently developed to integrate the pixel array 101 and the drive circuits 102 and 103 on the same substrate, for achieving a liquid crystal display apparatus of a smaller size and higher resolution and a lower mounting cost.

In the liquid crystal display apparatus of the drive circuit integrated type like this, when realizing a liquid crystal display apparatus of a transparent type, which is now widely used, its substrate needs to be a quartz substrate or a glass substrate, which is a transparent substrate. Further, in case the circuit is formed on the quartz substrate or the glass substrate, a polycrystalline silicone thin film transistor, which can be manufactured at a manufacturing temperature of no more than 600° C., is used as an active element, in view of heat resistance of the substrate.

FIG. 25 is a diagram illustrating an example of the liquid crystal display apparatus of the drive circuit integrated type. In the liquid crystal display apparatus, the pixel array 101, the scanning signal line drive circuit 102, and the data signal line drive circuit 103 are formed on a substrate (SUB) 107. In addition, provided on the substrate 107 is a precharge circuit (PC) 108, which is provided if the data signal line drive circuit 103, which is composed of the polycrystalline silicone thin film transistor, has low driving ability and its writing of data into the data signal lines SL thus needs assistance.

Next, driving methods of the data signal lines are explained. Analog driving methods include an analog point-by-point driving method and an analog line-by-line driving method, whereas digital driving methods include a selector type driving method, an R-DAC type driving method, and a C-DAC type driving method.

Among these driving methods, the analog line-by-line driving method, the selector type driving method, the R-DAC type driving method, and the C-DAC type driving method have following difficulties, when applied to the liquid crystal display apparatus of the drive circuit integrated type; it is difficult to locate on the substrate due to their strict design rules, it is difficult to respond to multiple tone gradation display, or they cause degradation of their display qualities.

In other words, in the liquid crystal display apparatus of the drive circuit integrated type, the polycrystalline silicone thin film is used for a semiconductor layer in the circuit as described above, but occupies a larger location area on the substrate in comparison to a mono-crystalline silicone.

Furthermore, more specifically, in the analog line-by-line driving method, an amplifier of high precision is required for amplifying the inputted video signals, but it is difficult to form the amplifier of high precision in a small area by using a polycrystalline silicone as a material of the semiconductor.

Besides, in the R-DAC type driving method and the C-DAC type driving method, reference voltage for displaying multiple tone gradations is generated by voltage dividing by dividing resistance or capacity. However, when an element of the resistance or the capacity, which is used as these voltage dividing means, is made of the polycrystalline silicone thin film, it is difficult to form the element in a small area. In addition, since the resistance or the capacity made of the polycrystalline silicone thin film has large property unevenness, it is impossible to achieve voltage dividing ratio as designed, thus degrading the display quality. Note that, when the elements using the polycrystalline silicone as the material of the semiconductor compose the drive circuit, the drive circuit needs to be composed of only logic elements, to prevent degradation of the display quality due to the property unevenness among the elements.

Moreover, in the selector type driving method, the reference voltage inputted from outside is supplied to the data signal lines SL via a selector circuit, corresponding to the video signals, and its circuit includes only a logic circuit and a transfer switch. Therefore, the selector type driving method has the simplest circuit structure among the digital driving methods. On the other hand, since a reference voltage source is required outside to supply an enough reference voltage to respond to the display tone gradations, it is only possible in practical use to obtain eight through sixteen tone gradations. This becomes a significant disadvantage in case a large number of tone gradations are displayed.

Because of the above reasons, for performing display having a further more number of tone gradations, on the liquid crystal display apparatus of the drive circuit integrated type, the analog line-by-line driving method, the selector type driving method, the R-DAC type driving method, or the C-DAC type driving method are not employed, but the analog point-by-point driving method is most generally used.

Here, the data signal line drive circuit in the analog point-by-point driving method is explained. In the data signal line drive circuit of the analog point-by-point driving method, as shown in FIG. 26, the inputted video signals DAT are written into the data signal lines SL, by opening and closing sampling circuits AS synchronously to an output pulse of each stage of flipflops (FFs) that constitutes a shift register.

More specifically, because the data signal line drive circuit of the analog point-by-point driving method only carries out transfer of the video signal DAT inputted from the outside to the data signal lines, its circuit structure is very simple so that the data signal line drive circuit of this kind can be used in the liquid crystal display apparatus of the drive circuit integrated type, while displaying multiple tone gradations without degrading the display quality.

In the data signal line drive circuit of the analog point-by-point driving method, however, an analog video signal output circuit with high driving ability is externally, thereby causing problems of increasing its electric power consumption as a system and significantly increasing its cost.

Furthermore, the drive circuit of the above described analog point-by-point driving method is provided with no digital interface. For this reason, even the liquid crystal display apparatus driven with an input of a digital signal requires a D/A (digital/analog) converting circuit externally to a display panel, in which the pixel array and the drive circuit are formed on the same substrate, thus further increasing the cost.

Here, as a driving method that includes the digital interface with low electric power consumption and an ability of displaying the multiple tone gradations in high display quality even when the polycrystalline silicone is used as the material of the semiconductor, there is a driving method using pseudo tone gradation processing.

Here an example of an arrangement of the conventional drive circuit using the pseudo tone gradation processing is illustrated in FIG. 27. In the data signal line drive circuit using the pseudo tone gradation processing, as shown in FIG. 27, the inputted digital video signals DAT are latched into a latch LAT, synchronizing to the output pulse of each stage of flipflops (FFs) that constitutes a shift register. The latched video signals are decoded by a decoder circuit DEC and the decoded video signals are subjected to the pseudo tone gradation processing in a line-by-line manner.

Here, the pseudo tone gradation processing in the arrangement of FIG. 27 is briefly explained as follows. The present pseudo tone gradation processing, by rounding off a less significant bit after a fixed noise pattern is superimposed on an image data, enables a low-bit drive circuit to display an image having more bits in a pseudo manner. The present pseudo tone gradation processing is one of the simplest arrangement among the pseudo tone gradation processing. In an image display apparatus of high definition, since the method to increase a number of tone gradations in the pseudo manner does not significantly degrade the image quality, its effect causes no problem in many cases.

In the arrangement of FIG. 27, the inputted video signals DAT and the fixed noise pattern memorized in a memory ROM are added together by an ADDER for each video signal to be respectively outputted to each data signal line, then subjected to an exception processing in case such as an overflow by an exception processing circuit OFP, and its less significant bit is rounded off by a quantization circuit QNT. According to the video signals subjected to the pseudo tone gradation processing like this, one of the reference voltages VREF corresponding to the video signals is selectively supplied to the data signal line SL by a selector circuit SEL.

As described above, the drive circuit using the pseudo tone gradation processing is provided with the digital interface, and can display multiple tone gradations in high display quality even when the polycrystalline silicone is used as the material of the semiconductor, and consumes a relatively small amount of electric power.

Nonetheless, since arrangements relating to the pseudo tone gradation processing, which are the adder ADDER, the exception processing circuit OFP, and the quantization circuit QNT, are provided to each data signal line. Therefore, the display apparatus of the drive circuit integrated type in which the pixel array and the drive circuit are formed on the same substrate should have a drive circuit having a very complicated arrangement. For this reason, when the drive circuit is composed of the element using the polycrystalline silicone as the material of the semiconductor, the drive circuit becomes too large, which causes problems such that manufacture of the drive circuit is practically difficult.

SUMMARY OF THE INVENTION

The object of the present invention is to provide an image display panel and an image display apparatus of a drive circuit integrated type in which a circuit arrangement of a drive circuit using pseudo tone gradation processing is simplified and a pixel array and a drive circuit are formed on a substrate.

In order to achieve the foregoing object, an image display panel of the present invention, which includes on a substrate (a) a pixel array having a plurality of pixels for displaying an image, and (b) a data signal line drive circuit for supplying video signals to the pixel array, wherein the data signal line drive circuit drives an n number of data signal lines for sending the video signals to the pixels on the pixel array and includes m stages of pseudo tone gradation processing means, for carrying out pseudo tone gradation processing with respect to the video signals that are to be sent respectively to the data signal lines, where $m<n$, and each of the pseudo tone gradation processing means sends to the data signal lines the video signals subjected to the pseudo tone gradation processing every m lines.

The image display panel has an m number of the pseudo tone gradation processing apparatus, which is less than a number of the data signal lines (n number), and which are used in common with respect to the video signals to be outputted to a plurality of data signal lines, respectively. This simplifies an arrangement of the data signal line drive circuit, thereby making it possible to display multiple tone gradations by using the simple circuit arrangement so simplified to be able to be applied to the image display panel of the drive circuit integrated type.

In addition, in the pseudo tone gradation processing apparatus, time for performing the pseudo tone gradation process of the video signals for one line is usually longer than time for inputting the video signals for one line. But by outputting the video signals subjected to the pseudo tone gradation processing to the data signal lines every m lines, each pseudo tone gradation processing apparatus is able to obtain the processing time m times as long as the input cycle of the video signals for the pseudo tone gradation processing of the video signals for one line.

For a fuller understanding of the nature and advantages of the invention, reference should be made to the ensuing detailed description taken in conjunction with the accompanying drawings.

DESCRIPTION OF THE EMBODIMENTS

An embodiment of the present invention is described as follows, referring to drawings.

Figure 2:
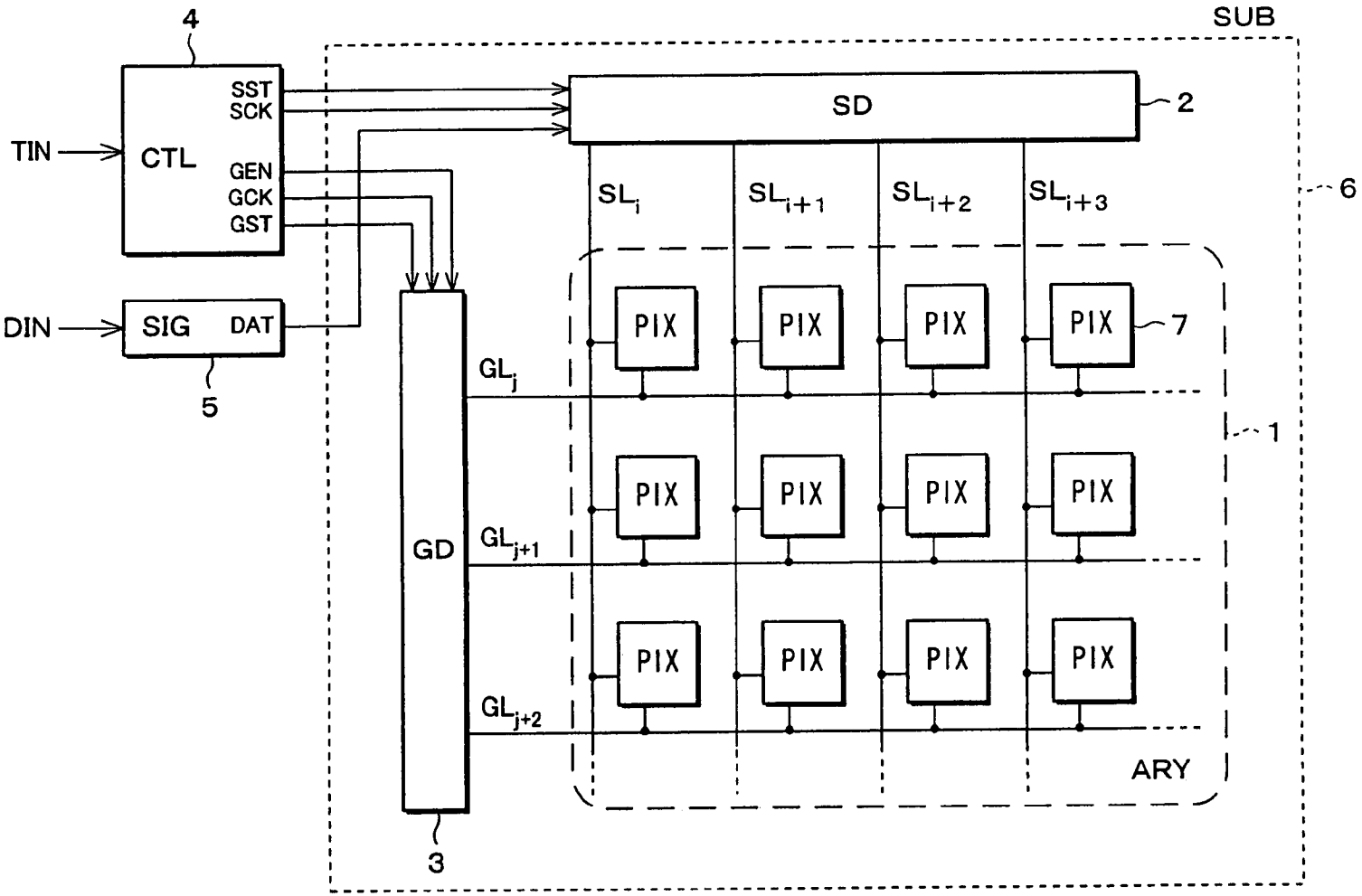
FIG. 2 is a block diagram illustrating an example of an arrangement of the image display apparatus.

An example of an arrangement of an image display apparatus in accordance with the present embodiment is shown in FIG. 2. Note that, in the image display apparatus in accordance with the present invention, its display method is not specifically limited. Namely, the present invention may be applied to a liquid crystal display apparatus, a plasma display apparatus, an EL display apparatus, and other type of display apparatuses, provided that the display apparatus has a data signal line drive circuit to send video signals to a pixel array including pixels positioned in a matrix manner.

The image display apparatus is, as shown in FIG. 2, provided with a pixel array (ARY) 1, a data signal line drive circuit (SD) 2, a scanning signal line drive circuit (GD) 3, a timing circuit (CTL) 4 for generating a timing signal, and a video signal circuit (SIG) 5 for generating the video signals.

The pixel array 1, the data signal line drive circuit 2, and the scanning signal line drive circuit 3 are formed on a substrate (SUB) 6. The pixel array 1 is composed of data signal lines SL, scanning signal lines GL, and pixels (PIX) 7. The data signal lines SL are driven by the data signal line drive circuit 2. The scanning signal lines GL, positioned so as to make right angles with the data signal lines SL, are driven by the scanning signal line drive circuit 3. The pixels 7 are positioned in a matrix manner, corresponding to each intersection of the data signal lines SL and the scanning signal lines GL.

The timing circuit 4, upon receipt of an input of an input control signal TIN, outputs a start signal SST and a clock signal SCK to the data signal line drive circuit 2, and outputs a start signal GST, a clock signal GCK, and a pulse width control signal GEN to the scanning signal line drive circuit 3. The video signal circuit 5, upon receipt of an input of an input video signal DIN, outputs a video signal DAT to the data signal line drive circuit 2.

Figure 1:
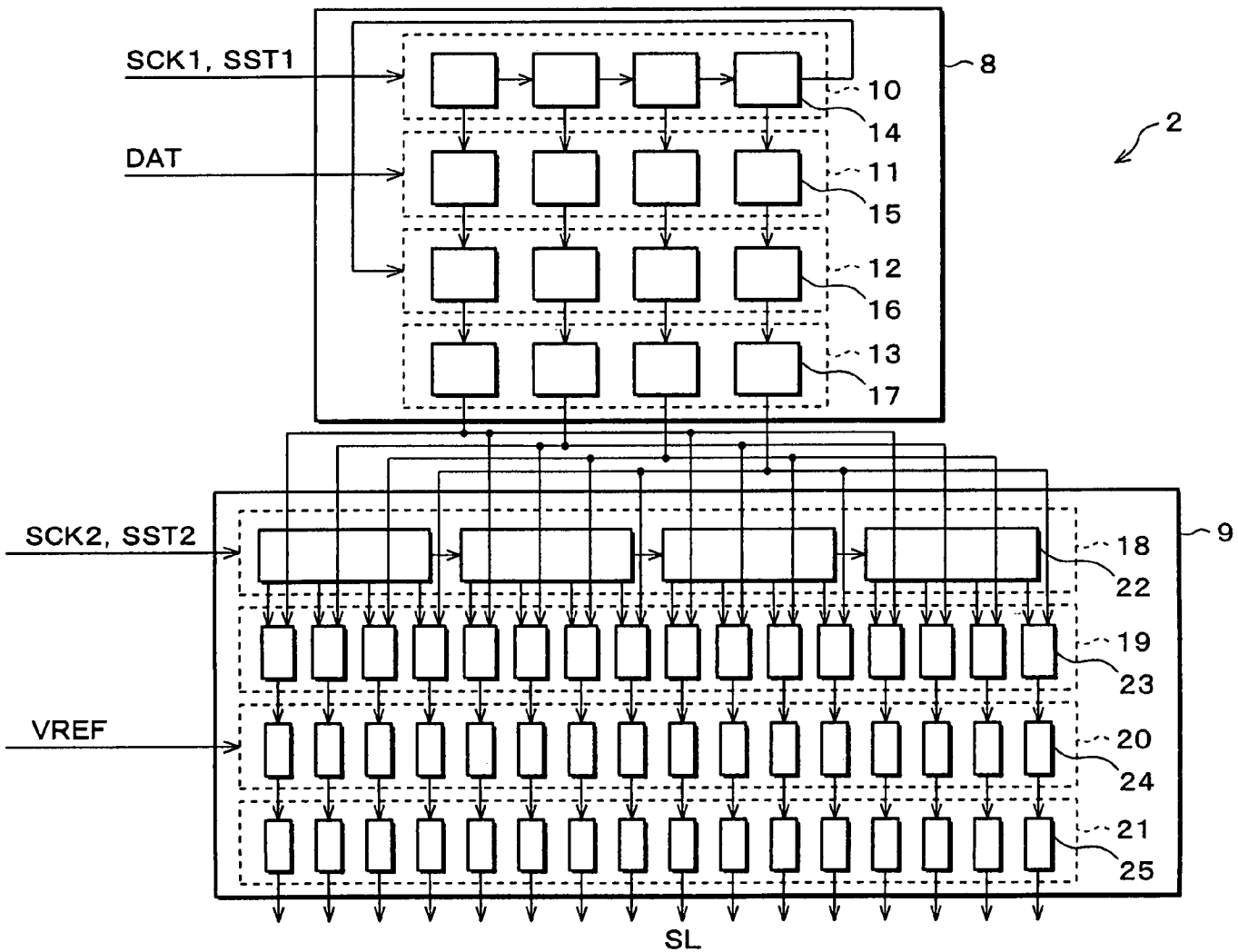
FIG. 1 is a circuit diagram illustrating an example of a data signal line drive circuit in an image display apparatus, showing an embodiment of the present invention.

Next, a specific example of an arrangement of the data signal line drive circuit 2 is shown in FIG. 1. The data signal line drive circuit 2 is, as shown in FIG. 1, functionally divided into a first block 8 and a second block 9. The first block 8 is a functional section that carries out pseudo tone gradation processing to the inputted digital video signals DAT. The second block 9 is a functional section that outputs the video signals subjected to the pseudo tone gradation processing to the data signal lines SL. A clock SCK 2 given to the second block 9 has a lower frequency than that of a clock SCK 1 given to the first block 8. The data signal line drive circuit 2 drives an n number of the data signal lines, but in the arrangement of FIG. 1, the number of the data signal lines is sixteen for convenience of explanation.

The first block 8 is provided with a shift register 10, a latch circuit 11, a parallelizing circuit 12, and a pseudo tone gradation processing circuit 13. The shift register 10 has m (m<n) stages of shift register sections 14. Likewise, the latch circuit 11 has m stages of latch sections 15, the parallelizing circuit 12 has m stages of parallelizing sections 16, and the pseudo tone gradation processing circuit 13 has m stages of pseudo tone gradation processing sections 17. More specifically, the first block 8 is provided with m stages of processing lines in which the shift register sections 14, the latch sections 15, the parallelizing sections 16, and the pseudo tone gradation processing sections 17, are arranged in series.

In the first block 8, the inputted digital video signals DAT are, synchronizing to each output of the shift register sections 14 of the shift register 10, sequentially latched into the latch sections 15 of the latch circuit 11 and polyphased by the parallelizing circuit 12. The pseudo tone gradation processing circuit 13 converts the polyphased digital video signal to have a bit number lower than that of the input video signal, via low-frequency processing.

The processing is explained as follows, referring to a timing chart of FIG. 3. First, the shift register 10 receives the first clock signal SCK 1 and a first start signal SST 1. Here, a frequency of the first start clock signal SCK 1 is m times as high as a frequency of the first start signal SST 1. More specifically, in the shift register 10, an ON pulse of the first start signal SST 1 is sequentially shifted according to a clock pulse of the first clock signal SCK 1 through m stage of the shift register section 14. Note that, the first start signal SST 1 may give only a first ON pulse, as long as it is so arranged that the input of the SST 1 is repeated in such a manner that after the last stage of the shift register sections 14, the first stage of the shift register sections 14 receives the input.

Figure 3:
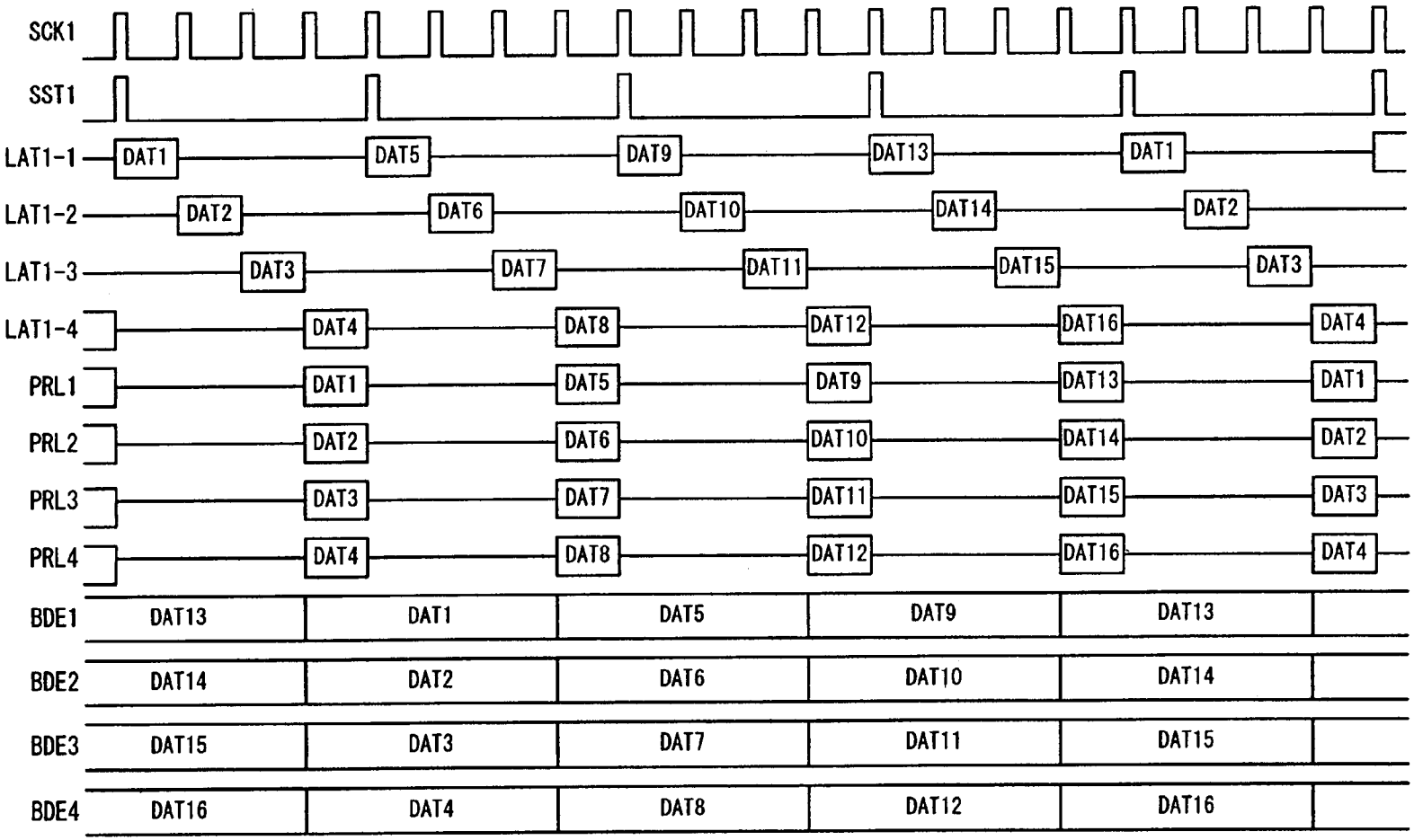
FIG. 3 is a timing chart illustrating a part of operation of the data signal line drive circuit shown in FIG. 1.

Accordingly, each shift register section 14 of the shift register 10 sequentially outputs an ON signal for each pulse of the first clock signal SCK 1, and each latch section 15 of the latch circuit 11, as shown in LATs 1-1 through 1-4 in FIG. 3, sequentially latches therein the video signal DAT synchronizing to the output, and keeps the video signal DAT for a determined period. Note that, in FIG. 3, DATs 1 through 16 refer to video signals to be sent respectively to the sixteen data signal lines.

The parallelizing circuit 12 receives the first start signal SST 1 sent from the last stage of the shift register 10. Accordingly, in the parallelizing circuit 12, as shown in PRLs 1 through 4 in FIG. 3, the video signals DAT kept in the latch sections 15 are collectively received by the parallelizing sections 16.

Each pseudo tone gradation processing section 17 of the pseudo tone gradation processing circuit 13, as shown in BDEs 1 through 4 in FIG. 3, receives the video signals DAT respectively from the parallelizing sections 16, and the video signals DAT are subjected to the pseudo tone gradation processing. Here, the pseudo tone gradation processing of the video signals for one line requires longer time than inputting the video signals for one line. In the arrangement of the data signal line drive circuit 2, however, as shown in FIG. 3, the pseudo tone gradation processing sections 17 receive the signal every four cycles of an input pulse of the clock signal SCK 1. For this reason, each pseudo tone gradation processing section 17 can obtain enough time for the pseudo tone gradation processing without lowering a working frequency of the data signal line drive circuit 2.

Next, the second block 9 is provided with a shift register 18, a latch circuit 19, a DA (digital/analog) converting circuit 20, and an output circuit 21. The shift register 18 has n/m stage of shift register sections 22. The latch circuit 19 has n stage of latch sections 23, the DA converting circuit 20 has n stage of DA converting sections 24, and the output circuit 21 has n stage of output sections 25. More specifically, the second block 9 has n/m stage of the shift register sections 14, and each stage of the shift register sections 14 is provided with m stage of processing lines in which the latch section 23, the DA converting section 24, and the output section 25, are arranged in series.

The processing of the second block 9 is explained as follows, referring to a timing chart of FIG. 4. Note that, processing at the second block 9 is applied to the video signals DAT already subjected to the processing of the first block 8. For this reason, to illustrate a processing flow from the first block 8 to the second block 9, FIG. 4 shows in a collective manner the first clock signal SCK 1, the first start signal SST 1, and the processing BDEs 1 through 4 at the pseudo tone gradation processing sections 17 that are shown in FIG. 3.

First, the shift register 18 receives a second clock signal SCK 2 and a second start signal SST 2. Here, a frequency of the second clock signal SCK 2 is n/m times as high as a frequency of the second start signal SST 2. More specifically, in the shift register 18, an ON pulse of the second start signal SST 2 is sequentially shifted according to a clock pulse of the second clock signal SCK 2 through n/m stage of the shift register sections 22. Note that, the second start signal SST 2 may give only a first ON pulse, as long as it is so arranged that the input of the SST 2 is repeated in such a manner that after the last stage of the shift register sections 22, the first stage of the shift register sections 22 receives the input.

Accordingly, each shift register section 22 of the shift register 18 sequentially outputs an ON signal of the second clock signal SCK 2 for one pulse. In addition, since each shift register section 22 is connected with m stages of the latch sections 23 (see FIG. 1), the latch sections 23 connected with the same shift register section 22 simultaneously latch therein the video signals DAT from the pseudo tone gradation processing circuit 13 of the first block 8.

Figure 4:
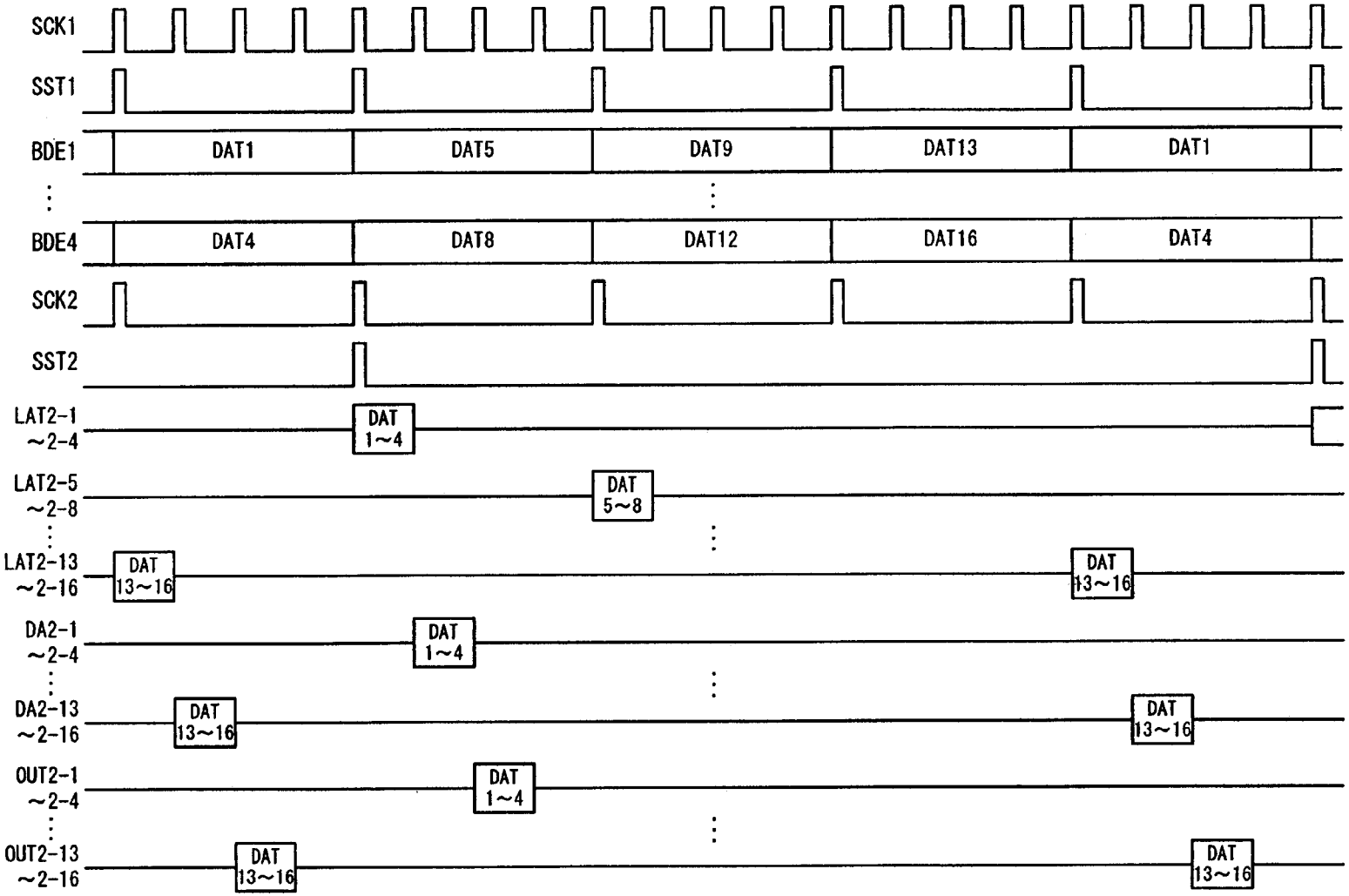
FIG. 4 is a timing chart illustrating a part of operation of the data signal line drive circuit shown in FIG. 1.

Specifically, where m=4 and n=16, when the first stage of the shift register sections 22 outputs the ON signal, first through fourth stages of the latch sections 23 latch therein the video signals DAT 1 through 4 to be sent to first through fourth data signal lines (see LATs 2-1 to 2-4 in FIG. 4). Likewise, when a second stage of the shift register sections 22 outputs the ON signal, fifth through eighth stages of the latch sections 23 latch therein the video signals DAT 5 through 8 to be sent to fifth through eighth data signal lines; when a third stage of the shift register sections 22 outputs the ON signal, ninth through twelfth stages of the latch sections 23 latch therein the video signals DAT 9 through 12 to be sent to ninth through twelfth data signal lines, and when the last stage of the shift register sections 22 outputs the ON signal, thirteenth through sixteenth stages of the latch sections 23 latch therein the video signals DAT 13 through 16 to be sent to thirteenth through sixteenth data signal lines.

The video signals DAT latched into the latch circuit 19 are sent, collectively as to m stages, to the DA converting circuit 20 and the output circuit 21, and converted into an analog signal for driving the liquid crystal at each DA converting section 24 of the DA converting circuit 20, then sent respectively to the data signal lines SL via each output section 25 of the output circuit 21.

Here, the first clock signal SCK 1 has a higher frequency than the second clock signal SCK 2. However, by integrally multiplying the frequency of the first clock signal SCK 1 with respect to the frequency of the second clock signal SCK 2, as shown in FIG. 1, relation between an output of the first block 8 and an input of the second block 9 is simplified. This allows its circuit structure to be simple. Namely, one output terminal of the first block 8 may be connected with a plurality of input terminals of the second block 9.

Furthermore, as shown in FIG. 4, since the second clock signal SCK 2 has the same frequency with that of the first start signal SST 1, it is possible to generate the second clock signal SCK 2 by using an output of the first start signal SST 1 from the last stage of the shift register 10, thus eliminating need of inputting the second clock signal SCK 2 from outside. This can be easily realized when the frequency of the first clock signal SCK 1 is integrally multiplied with respect to the frequency of the second clock signal SCK 2, as in FIG. 1.

Figure 5:
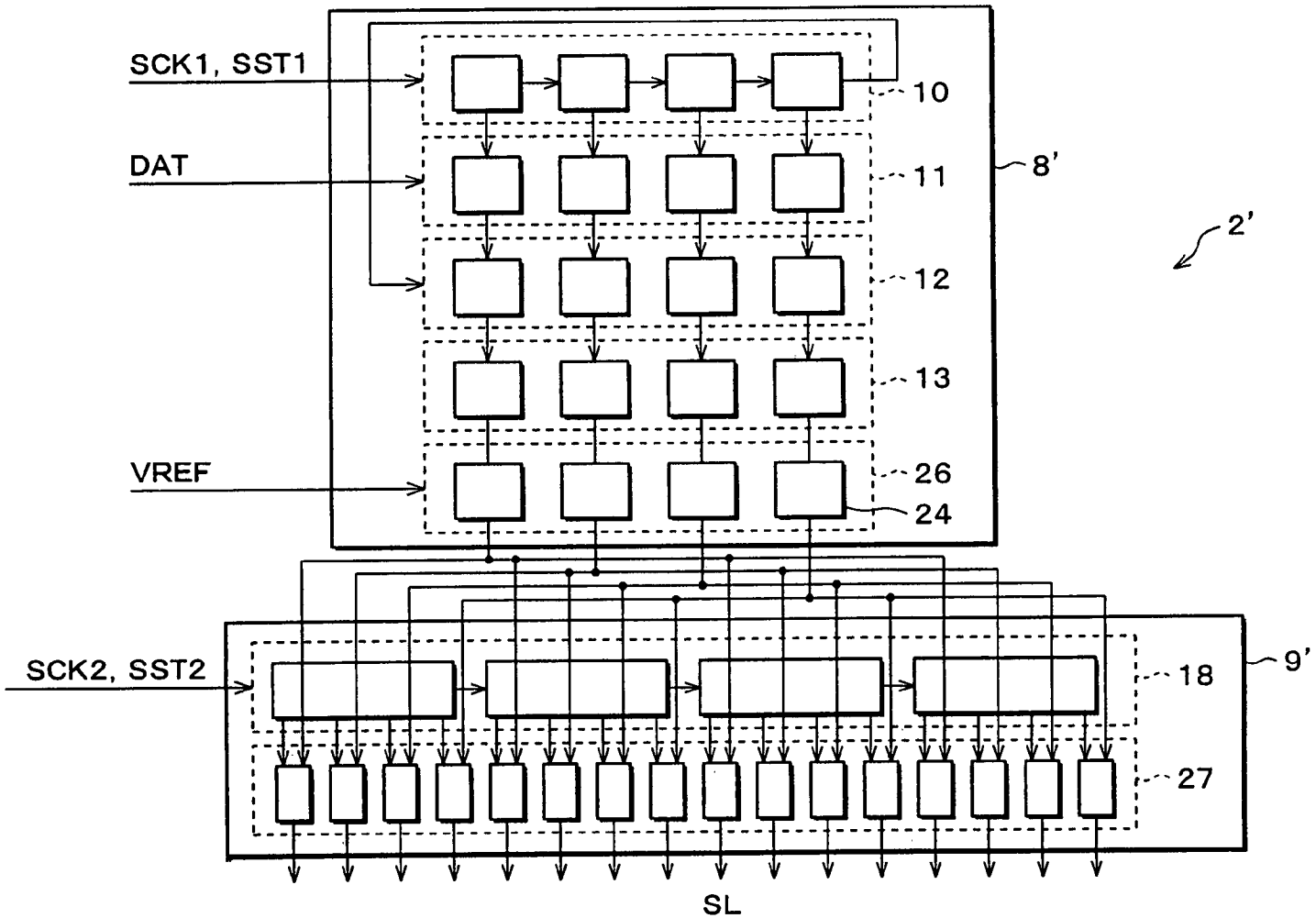
FIG. 5 is a circuit diagram illustrating another example of the data signal line drive circuit in the image display apparatus of the present invention.

Moreover, a data signal line drive circuit 2' of an arrangement shown in FIG. 5 may be used as a modified example of the arrangement of FIG. 1. In the data signal line drive circuit 2' in FIG. 5, identical reference numerals are assigned to members identically arranged as in the data signal line drive circuit 2 shown in FIG. 1, thus their explanation is omitted here.

The data signal line drive circuit 2' is functionally divided into a first block 8' and a second block 9'. The first block 8' is provided with a shift register 10, a latch circuit 11, a parallelizing circuit 12, a pseudo tone gradation processing circuit 13, and a DA converting circuit 26. The second block 9' is provided with a shift register 18 and an output circuit 27.

More specifically, in the arrangement of FIG. 5, the DA converting circuit is located in a different position in comparison to the arrangement of FIG. 1. In the data signal line drive circuit 2', the inputted digital video signals DAT are latched into the latch circuit 11 synchronously to each output of the shift register 10, and polyphased by the parallelizing circuit 12. The pseudo tone gradation processing circuit 13 converts the polyphased digital video signal to have a bit number lower than that of the input video signal, via low-frequency processing.

The video signal DAT converted by the pseudo tone gradation processing circuit 13 is converted, by the DA converting circuit 26, to an analog video signal for driving the liquid crystal, and then sent to the data signal lines SL via the output circuit 27 that operates synchronously to each output of the shift register 18.

Here, the data signal line drive circuit 2 of the arrangement shown in FIG. 1 and the data signal line drive circuit 2' of the arrangement shown in FIG. 5 respectively have advantages as shown below. Namely, in the data signal line drive circuit 2, the video signals DAT subjected to the pseudo tone gradation processing by the pseudo tone gradation processing circuit 13 are latched by the latch circuit 19 and then subjected to the D/A conversion before being sent to the output circuit 21. For this reason, the video data are treated as digital signals until being sent to the data signal lines SL, the video data are less subject to influences of a noise or a subtle timing lag.

On the other hand, in the data signal line drive circuit 2', the video signals DAT subjected to the pseudo tone gradation processing by the pseudo tone gradation processing circuit 13 are subjected to the D/A converting right after the pseudo tone gradation processing. For this reason, even though the data signal line drive circuit 2' is more subject to the noise or the subtle timing lag in comparison to the data signal line drive circuit 2, the circuit structure of the data signal line drive circuit 2' can be simplified because its DA converting section 24 requires only m stages in comparison to the structure of the data signal line drive circuit 2 that requires the DA converting section 24 for each line (n stages). In the data signal line drive circuits 2 and 2', the circuit structure of the DA converting sections 24 can be composed of the shift register, a simple gate such as an inverter and a NAND, and an analog switch. This allows the DA converting section 24 itself to be very simple and compact.

Figure 6:
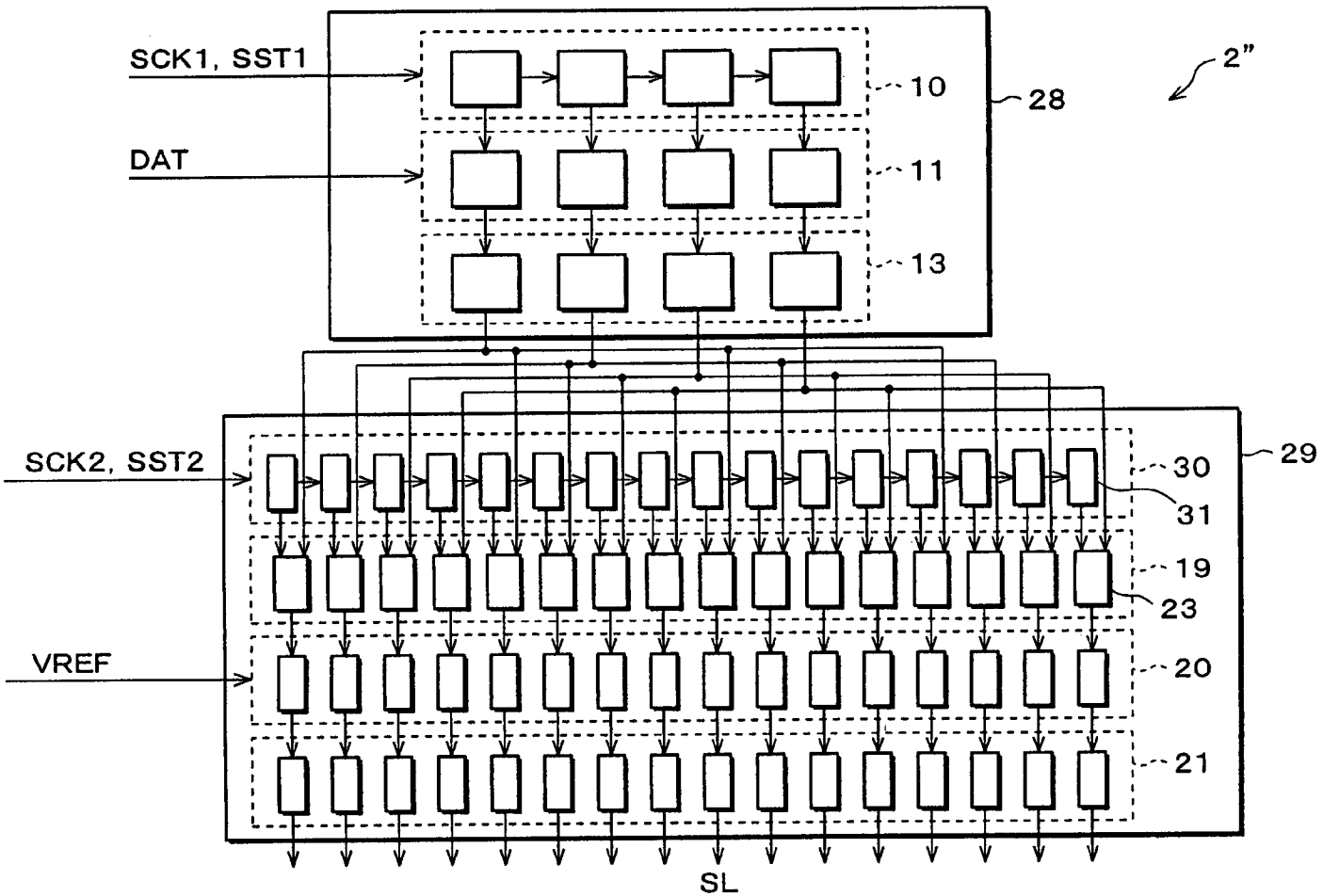
FIG. 6 is a circuit diagram illustrating yet another example of the data signal line drive circuit in the image display apparatus of the present invention.

Furthermore, as another modified example of the data signal line drive circuit, an arrangement shown in FIG. 6 may be employed. In a data signal line drive circuit 2" in FIG. 6, identical reference numerals are assigned to members identically arranged as in the data signal line drive circuit 2 shown in FIG. 1, thus their explanation is omitted here.

The data signal line drive circuit 2" is functionally divided into a first block 28 and a second block 29. The first block 28 is provided with a shift register 10, a latch circuit 11, and a pseudo tone gradation processing circuit 13. The second block 29 is provided with a shift register 30, a latch circuit 19, a DA converting circuit 20 and an output circuit 21.

In the first block 28, the shift register 10 and the latch circuit 11 operate identically with respect to the first block 8 of the data signal line drive circuit 2. In the first block 28, however, since the parallelizing circuit 12 is omitted, an input of the video signal data DAT to each pseudo tone gradation processing section 17 of the pseudo tone gradation processing circuit 13, as shown in a timing chart of FIG. 7, shifts by one pulse of the first clock signal SCK 1 (BDEs 1 to 4 in FIG. 7).

Moreover, in the second block 28, the shift register 30 is so arranged that the number of stages of the shift register section 31 is not n/m stages, but n stages, being different from the shift register 10 of the data signal line drive circuit 2. Further, the second clock signal SCK 2 inputted into the shift register 30 has the same frequency with respect to the first clock signal SCK 1.

Figure 7:
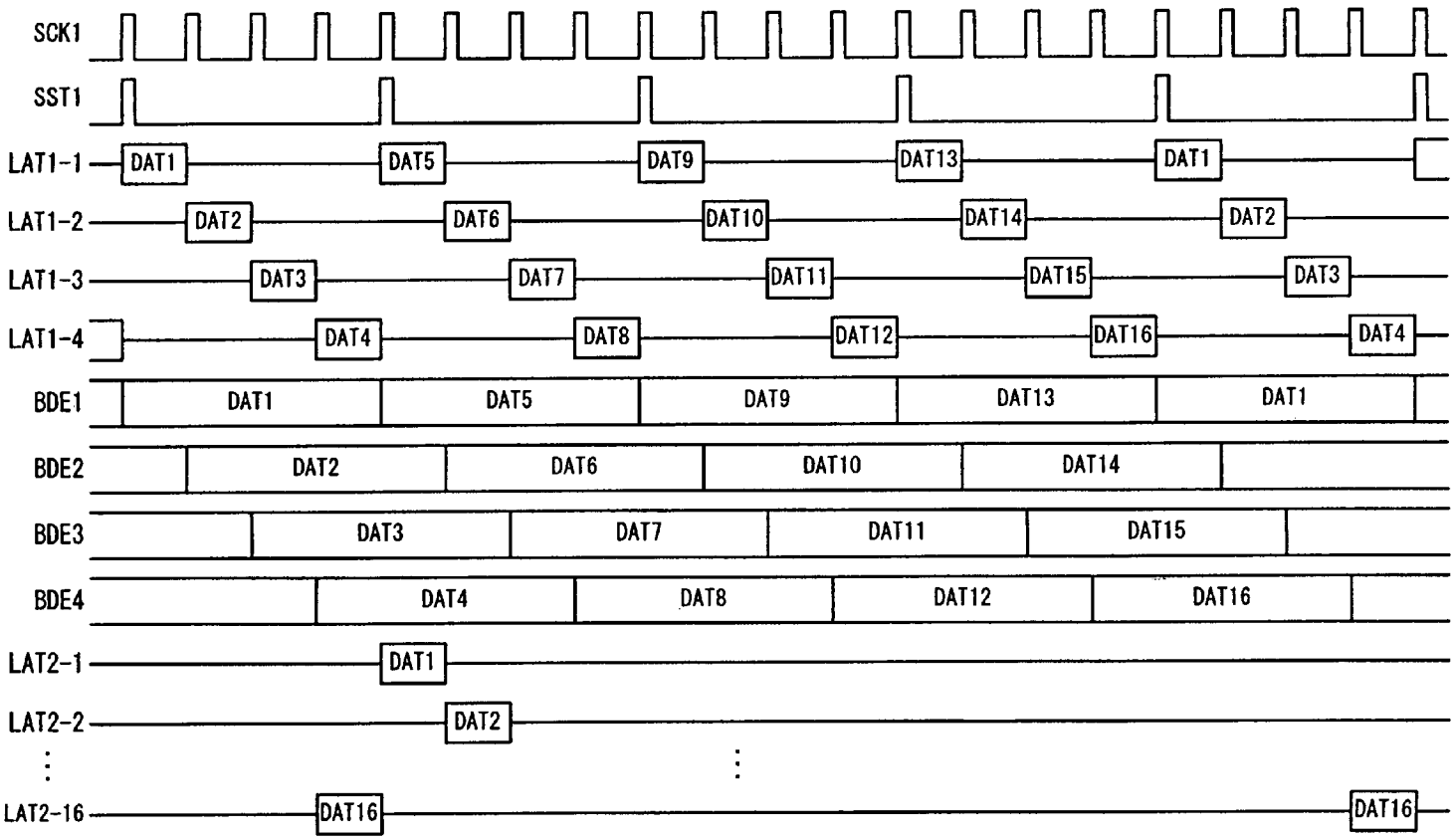
FIG. 7 is a timing chart illustrating operation of the data signal line drive circuit shown in FIG. 6.

For this reason, in the second block 28, each latch section 23 of the latch circuit 19 latches therein the video signals DAT subjected to the pseudo tone gradation processing in a line-by-line manner in accordance with the second clock signal SCK 2 (LATs 2-1 to 2-16 in FIG. 7). Further, even though it is omitted in the timing chart of FIG. 7, processing of the DA converting circuit 20 and the output circuit 21 is also carried out in a line-by-line manner in accordance with the second clock signal SCK 2.

Note that, in the data signal line drive circuit 2", the DA converting circuit 20 is provided in n stages at a downstream (as to a processing flow of the video signal, an inputting side to the data signal line drive circuit is called as an upstream, while an outputting side is called as a downstream) of the latch circuit 19 as in the arrangement of FIG. 1, but the DA converting circuit 26 may be provided in m stages after the pseudo tone gradation processing circuit 13 as in the arrangement of FIG. 5.

Here, according to the arrangement of FIG. 1 or FIG. 5 (a first arrangement), since each stage of the shift register sections 22 in the shift register 18 deals with a plurality of the data signal lines SL (m number), a number of the stages of the shift register sections 22 is able to be 1/m of the number of the data signal lines (n number). This allows a scale of the data signal line drive circuits 2 or 2" to be small. Further, since a frequency of the clock signal SCK 2 given to the shift register 18 becomes 1/m of a frequency of the clock signal SCK 1 given to the shift register 10, the latch circuit 19 (or the output circuit 27) can have long time for sending data to the data signal lines SL.

Moreover, according to the arrangement of FIG. 6 (a second arrangement), by using a sum of a plurality of output signals from the shift register 30, the latch circuit 19 can obtain long time for sending data to the data signal lines SL. Besides, in this arrangement, the same signal as the first clock signal SCK 1 that controls the shift register 10 may be used as the second clock signal SCK 2 that controls the shift register 30. Therefore, a circuit for generating a new signal is not required. Further, since the sequential output of the data to the data signal lines SL gives such a merit that block-by-block border unlikely occurs, which may be caused in case of collective output of a plurality of data.

Figure 8:
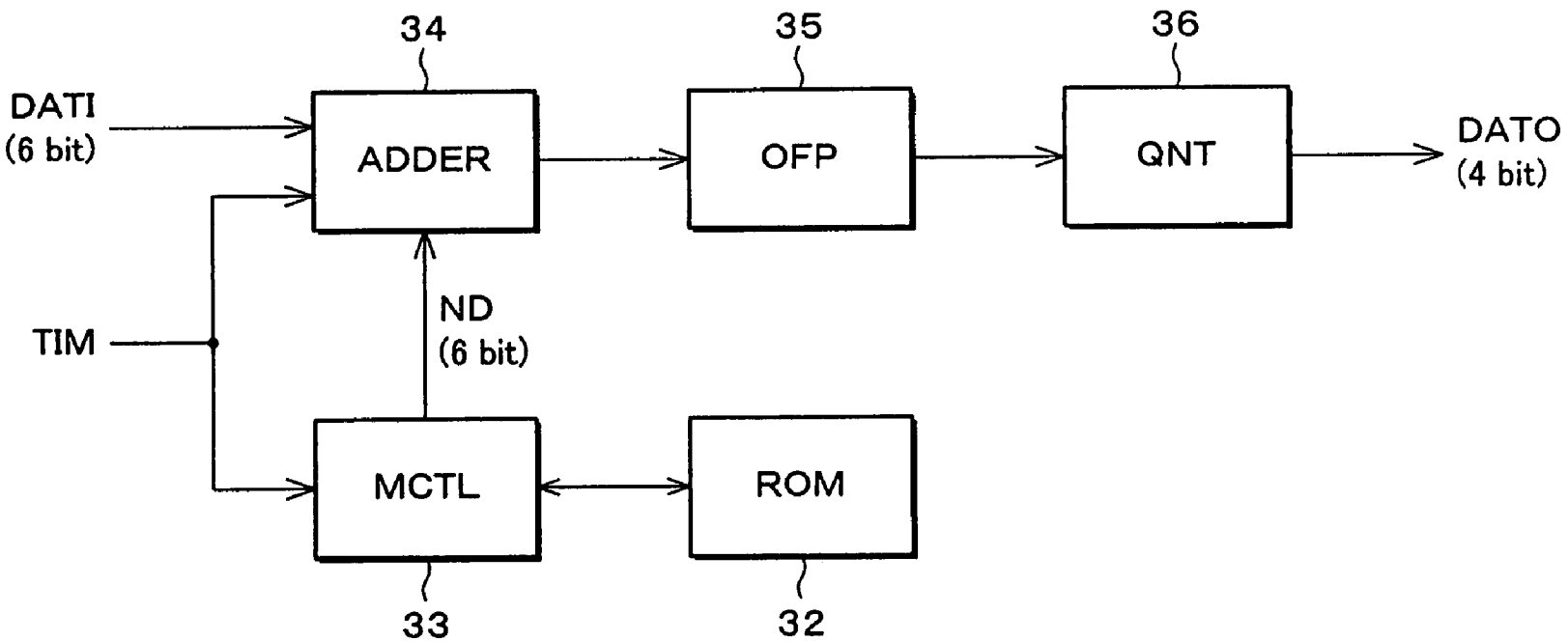
FIG. 8 is a block diagram illustrating an example of an arrangement of a pseudo tone gradation processing circuit in the data signal line drive circuits shown in FIG. 1, FIG. 5 and FIG. 6.

In the data signal line drive circuit, a variety of arrangements may be applied for the pseudo tone gradation processing circuit 13, but an arrangement shown in FIG. 8 is explained here as its example. The pseudo tone gradation processing circuit 13 of this arrangement is to display a multi-bit image with in a low-bit drive circuit in a pseudo manner, by rounding off a less significant bit after the fixed noise pattern is superimposed on the image data. This arrangement is one of the simplest arrangements among those of the pseudo tone gradation processing. In an image display apparatus of high definition, the method to increase the number of tone gradations in a pseudo manner causes no problem in many cases because its image quality is not significantly degraded with this method.

In FIG. 8, a fixed noise pattern ND that is memorized in a memory (ROM) 32 is read by a memory control circuit (MCTL) 33, and added by an adder (ADDER) 34 to an inputted video signal DATI. After subjected to the exception processing in case such as an overflow by the exception processing circuit (OFP) 35, the added data of the video signal DATI and the fixed noise pattern ND is rounded off its less significant bit, thereby offering a video signal DATO with a lowered bit number. As described above, this method is characterized in realizing the pseudo tone gradation processing with a very simple arrangement.

Figure 9:
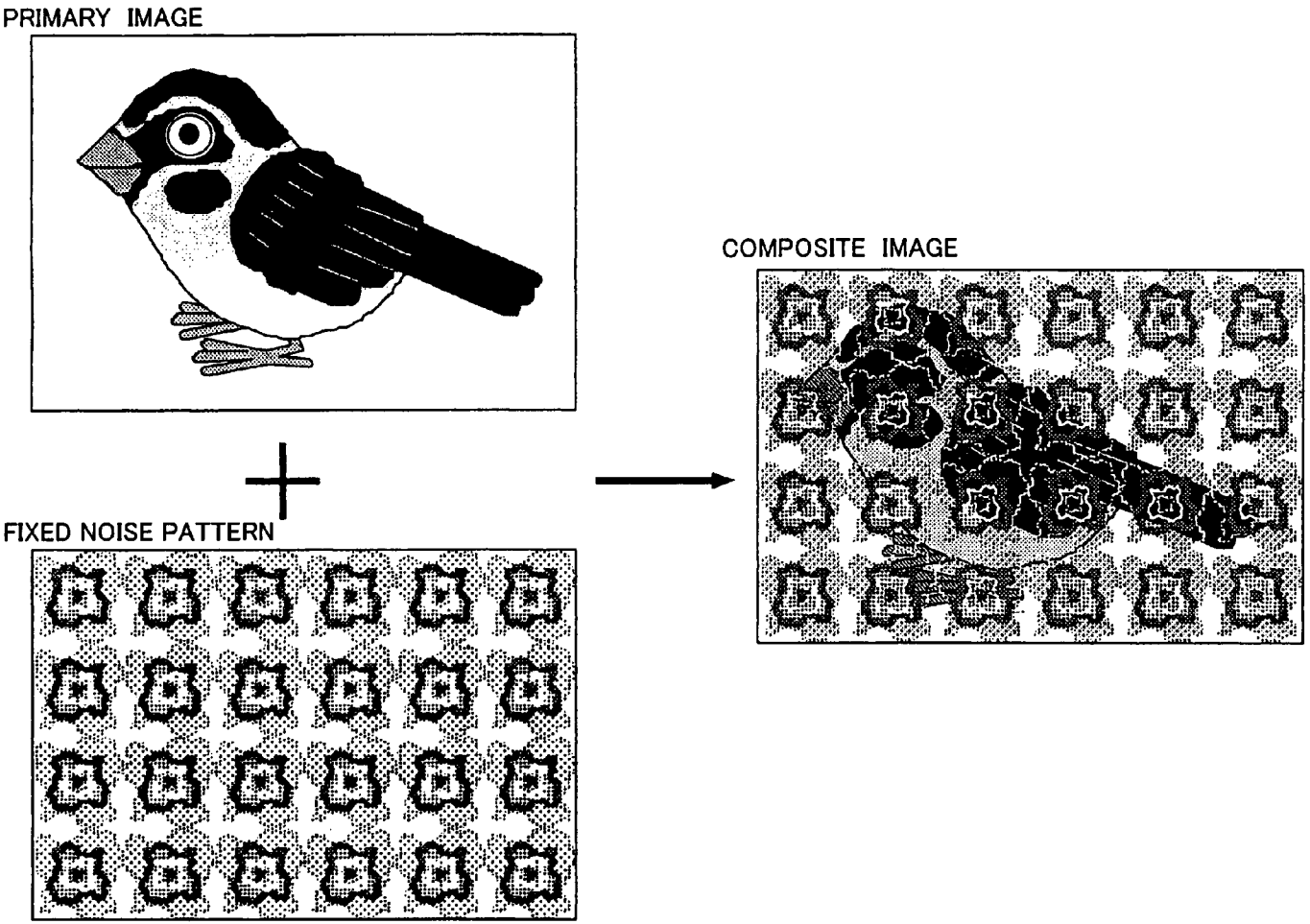
FIG. 9 is an explanatory diagram illustrating an example of image processing of the pseudo tone gradation processing circuit.

An example of the image display for this case is shown in FIG. 9. A composite image that composes an original image (a primary image) and the fixed noise pattern is lower in its quality than the primary image, but is more visible than a case where the primary image is just displayed in low tone gradations.

In the pseudo tone gradation processing circuit 13, it is desirable to optimize all screen of the fixed noise pattern that is to be memorized in ROM 32 in terms of the display quality. However in this case, it is a problem that a data quantity of the memory becomes large. To solve this problem, it is effective to use a fixed noise pattern that is obtained from repeating a certain size of pattern data (for example, each of height and width has sixteen pixels) for the fixed noise pattern to be superimposed on the video data.

In this case, when a cycle of the pattern data (a cycle in a horizontal direction) is integrally multiplied with respect to a cycle of the video signals DAT that is parallelized by the parallelizing circuit 12 (that is, a width of the data signal lines of the pattern data in their aligned direction is made to correspond to a number of lines obtained by the integral multiplication of m), the structure of the pseudo tone gradation processing circuit 13 becomes quite simple.

Figure 10:
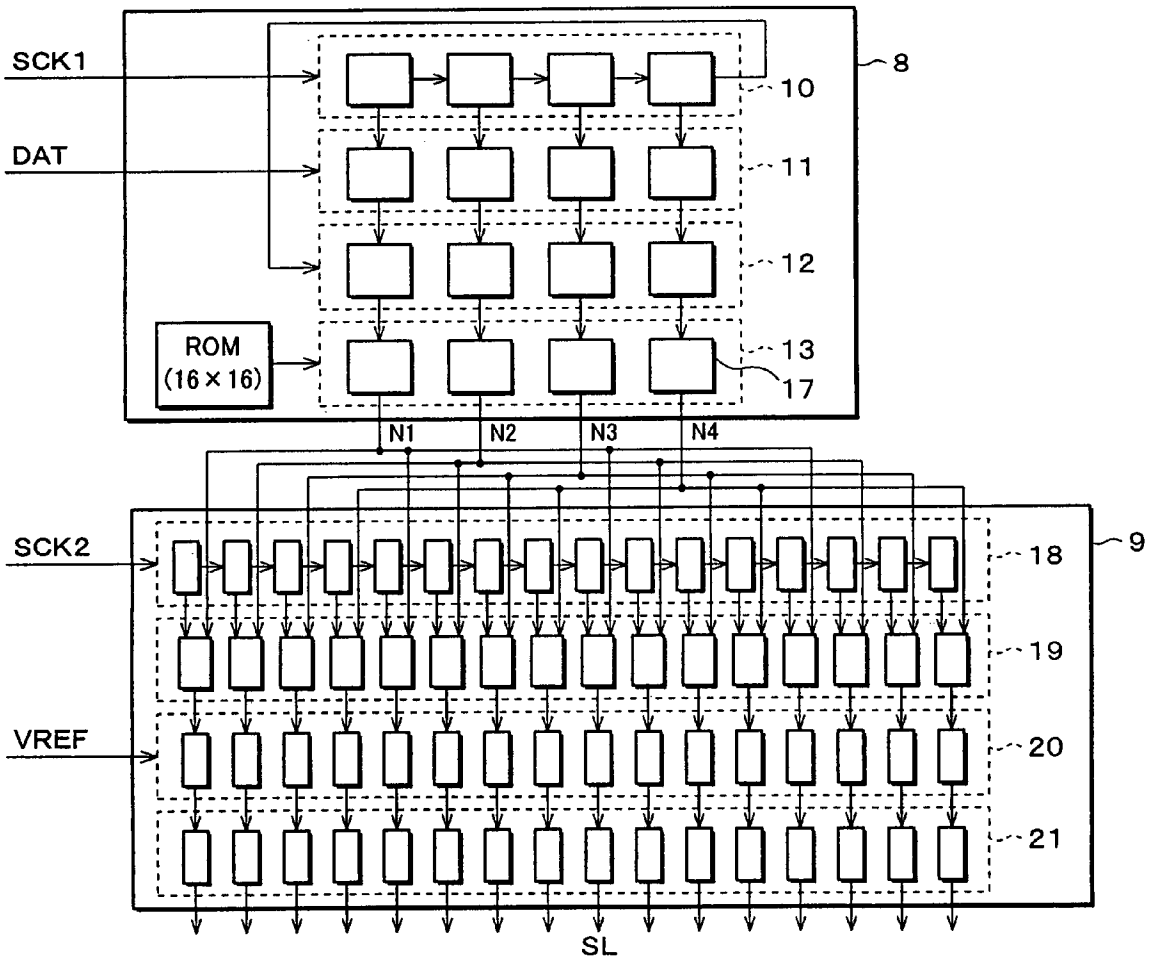
FIG. 10 is a circuit diagram illustrating still another example of the data signal line drive circuit in the image display apparatus of the present invention.

For example, as shown in FIG. 10, where the cycle of the pattern data is sixteen pixels and a number of outputs from the first block 8 (a parallelizing cycle of the video signals) is four, each adder 34 of each pseudo tone gradation processing section 17 of the pseudo tone gradation processing circuit 13 receives only a determined signal among the pattern data signals read by the memory control circuit 33 from the memory 32. This eliminates need for switching their connecting relations.

Figure 11:
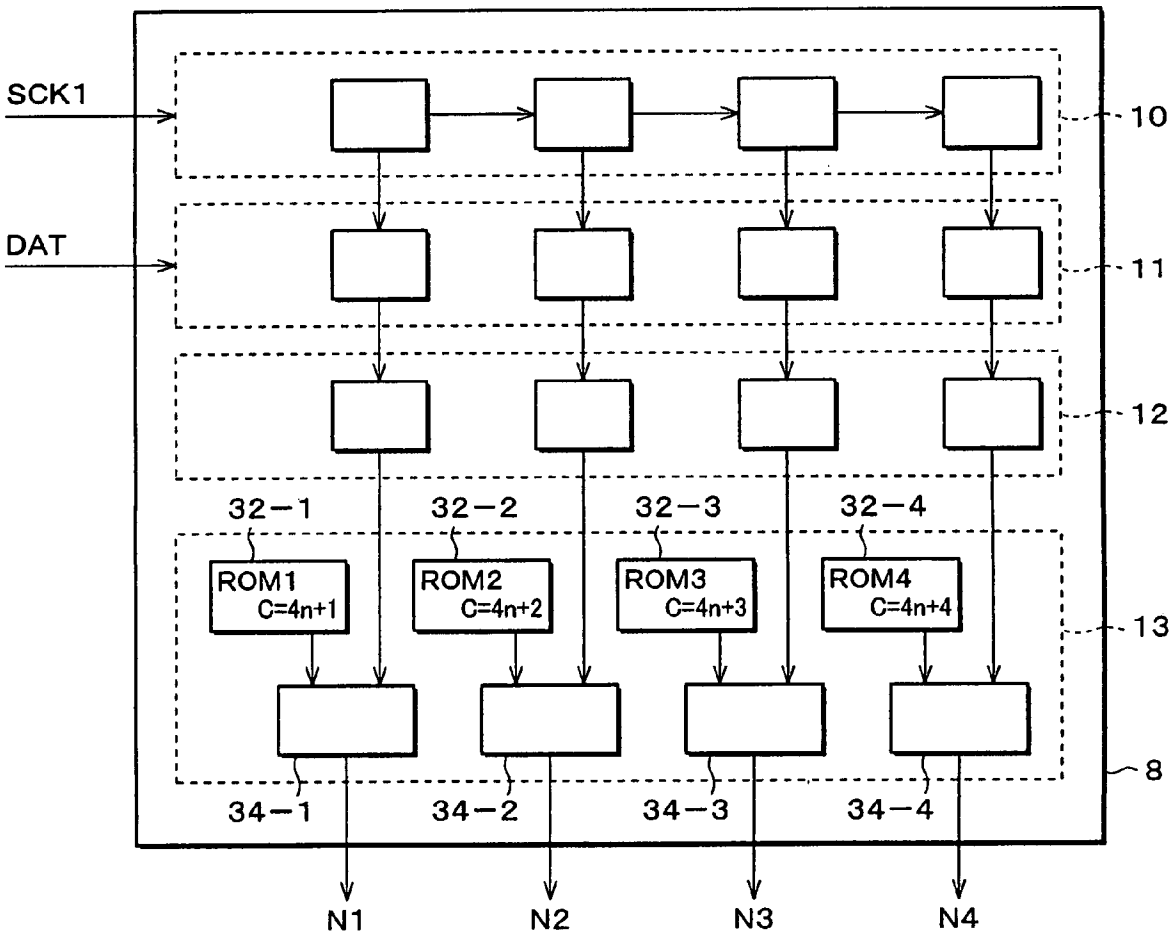
FIG. 11 is a circuit diagram of still yet another example of a first block in the data signal line drive circuit in the image display apparatus of the present invention.

For a more concrete example, as shown in FIG. 11, four adders 34-1 to 34-4 in the pseudo tone gradation processing circuit 13 are connected respectively with their corresponding memories (ROMs 1 to 4) 32-1 to 32-4, which memorize only the pattern data used by the adders 34-1 to 34-4. Such an arrangement simplifies a connection between the memory 32 and the adder 34 without increasing the data quantity of the memory.

As explained in FIGS. 10 and 11, when the fixed noise pattern is generated by repeating the certain size of the pattern data, the data quantity of the memory can be reduced. On the other hand, the method may not be desirable in terms of the display quality because vertical stripes or block stripes that correspond to the repeating pitch (a pseudo pattern) becomes more visible.

Figure 12:
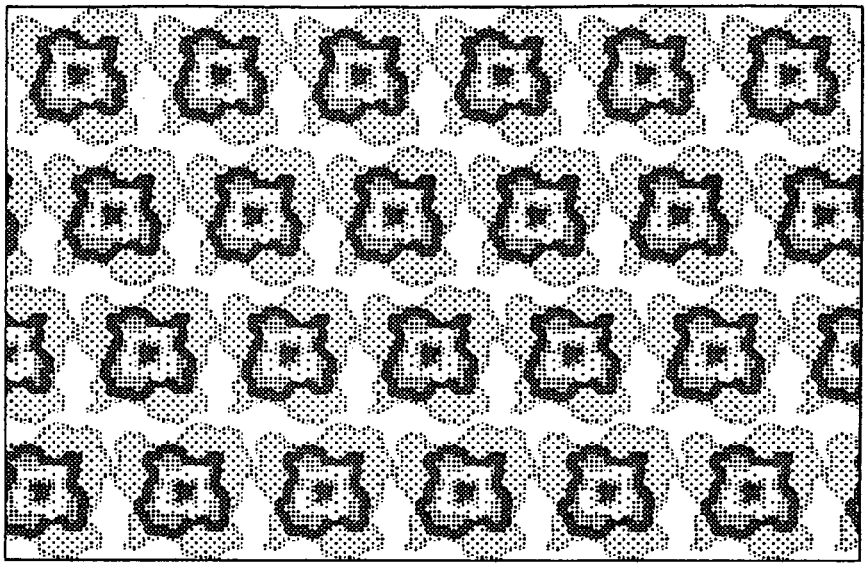
FIG. 12 is an explanatory diagram illustrating an example of a fixed pattern in the pseudo tone gradation processing circuit.
Figure 13:
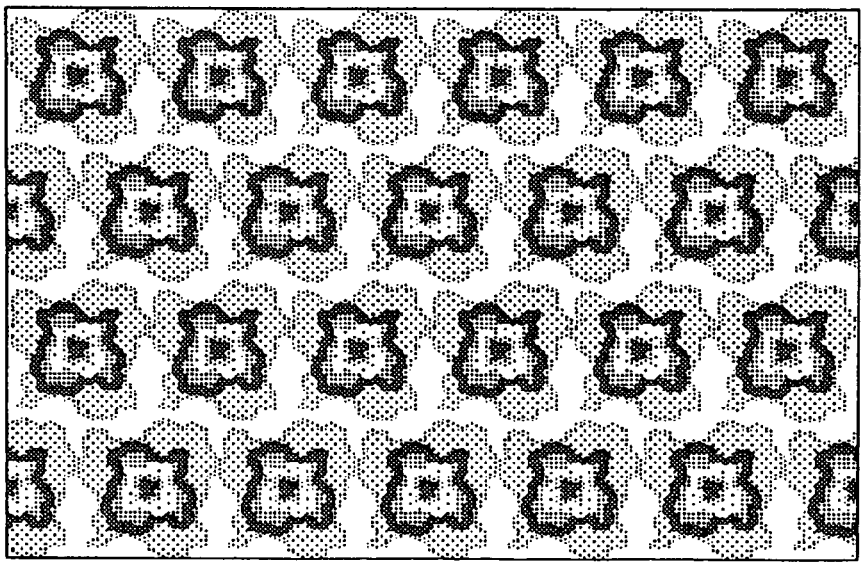
FIG. 13 is an explanatory diagram illustrating another example of the fixed pattern in the pseudo tone gradation processing circuit.

For this reason, as shown in FIG. 12, by shifting the pattern data constituting the fixed noise pattern for a certain amount in a horizontal direction per vertical cycle of the fixed noise pattern, the degradation of the display quality can be reduced. Besides, as shown in FIG. 13, by setting the amount of shifting in the horizontal direction to be a 1/k (K is an integral number not less than 2: FIG. 13 is when k=2) cycle of the pattern data, timing control for reading out from the memory (switching a read-out starting address) becomes easy, thereby simplifying the arrangement of the pseudo tone gradation processing circuit 13.

Moreover, the pattern data constituting the fixed noise pattern may not be shifted per cycle of the fixed noise pattern in the vertical direction, but may be shifted per certain frame cycle. Also in this case, it is avoided that the consecutive frames have identical patterns in identical positions. This makes difficult to recognize a block-shaped pseudo pattern caused by the pattern data signal superimposed on the video signal, thereby improving the display quality.

Besides, to shift the pattern data per one frame period is most effective for making the block-shaped pseudo pattern less recognizable because the succession of the identical fixed patterns are the shortest. Note that, when the fixed pattern data is shifted per two frame period, the display quality is improved by making the pseudo pattern less recognizable and degradation of the liquid crystal material is reduced because a DC component of voltage applied on the liquid crystal is canceled corresponding to an AD drive of the liquid crystal, thereby effectively improving reliability of the display apparatus.

Moreover, also in this case, by setting the amount of shifting in the horizontal direction to be a 1/k (K is an integral number not less than 2: FIG. 13 is when k=2) cycle of the pattern data, the timing control for the reading out from the memory (switching the read-out starting address) becomes easy, thereby simplifying the arrangement of the pseudo tone gradation processing circuit 13.

Furthermore, for improving the display quality by further reducing the recognition of the pseudo pattern, it is another option to change, per certain frame cycle, the pattern data that is superimposed on the video signal.

More specifically, when the pattern data to be superimposed on the video signal is shifted in a horizontal direction per certain frame cycle, movement of the block-shaped pseudo pattern may be recognized. However, by using a completely different pattern data per frame, the block-shaped pseudo pattern becomes further less recognizable, thereby further improving the display quality.

Of course, as to the cycle to shift the pattern data, to shift per one frame period is most effective for making the block-shaped pseudo pattern less recognizable, and to shift per two frame period can improve both of the display quality and the reliability of the display apparatus.

Moreover, when the pattern data to be superimposed on the video data is changed per certain frame cycle, by repeating the identical pattern data, which is to be superimposed on the video signal, for the certain cycle, it is possible to limit types of the pattern data, thereby reducing the capacity of the memory means for storing the pattern data.

Next, an arrangement of the DA converting circuit is explained. Though many methods that have been conventionally proposed may be employed for the arrangement of the DA converting circuit, it is most desirable to use a DA converting circuit of a selector type that selects and outputs a voltage corresponding to the display tone gradations from a plurality of reference voltage sources, for fully utilizing the advantage of the present invention.

Figure 14:
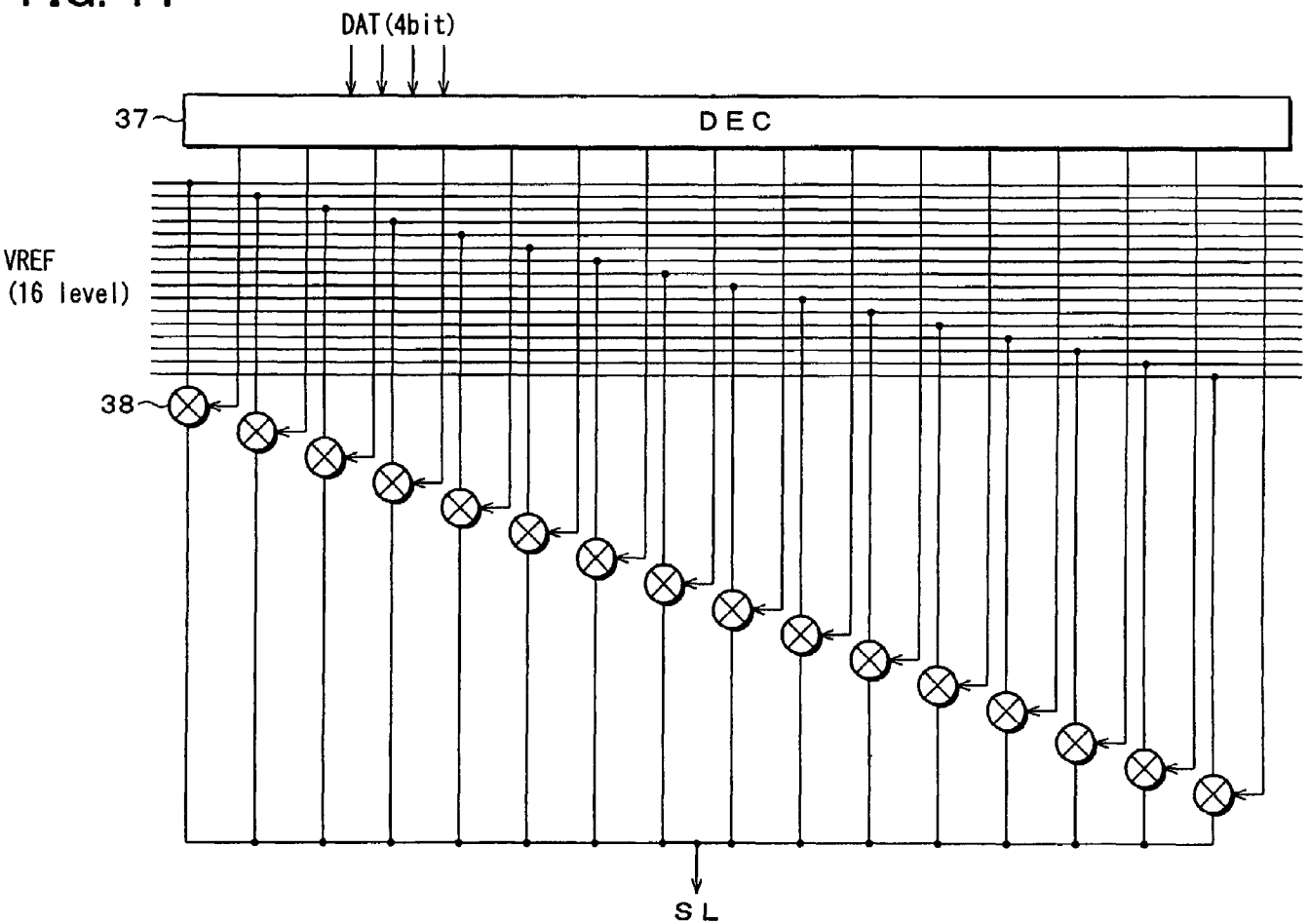
FIG. 14 is a circuit diagram illustrating an example of an arrangement of a DA converting section in the image display apparatus of the present invention.

The DA converting circuit of the selector type, as shown in FIG. 14, by using a signal that is the 4-bit digital video signal DAT decoded by the decoder 37, controls switches 38 between a plurality (the number is sixteen in the figure) of reference voltage lines VREF and the output lines (the data signal lines SL in the figure) and selects one reference voltage. As described above, the DA converting circuit is composed of only the decoder, which is a logic circuit, and the switch, which is a transfer gate.

Accordingly, even if the DA converting circuit is made by using the polycrystalline silicone as the material of the semiconductor, the image display of high quality can be realized without being significantly affected by property unevenness or property change. Further, it is possible to realize the data signal line drive circuit and the image display apparatus that consume small electric power due to a lack of a flowing route for stationary electric current.

Figure 15:
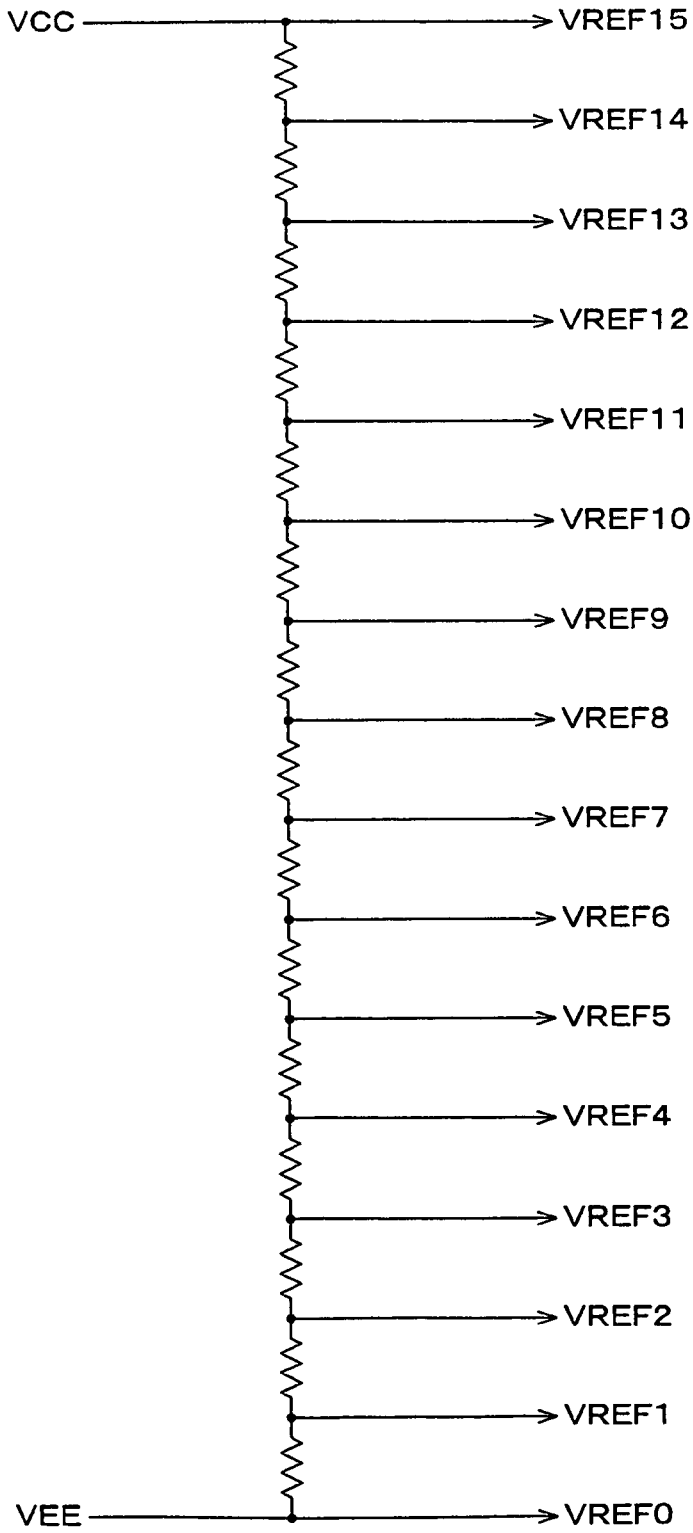
FIG. 15 is a circuit diagram illustrating an example of a generating section of a reference voltage source in the DA converting section.
Figure 16:
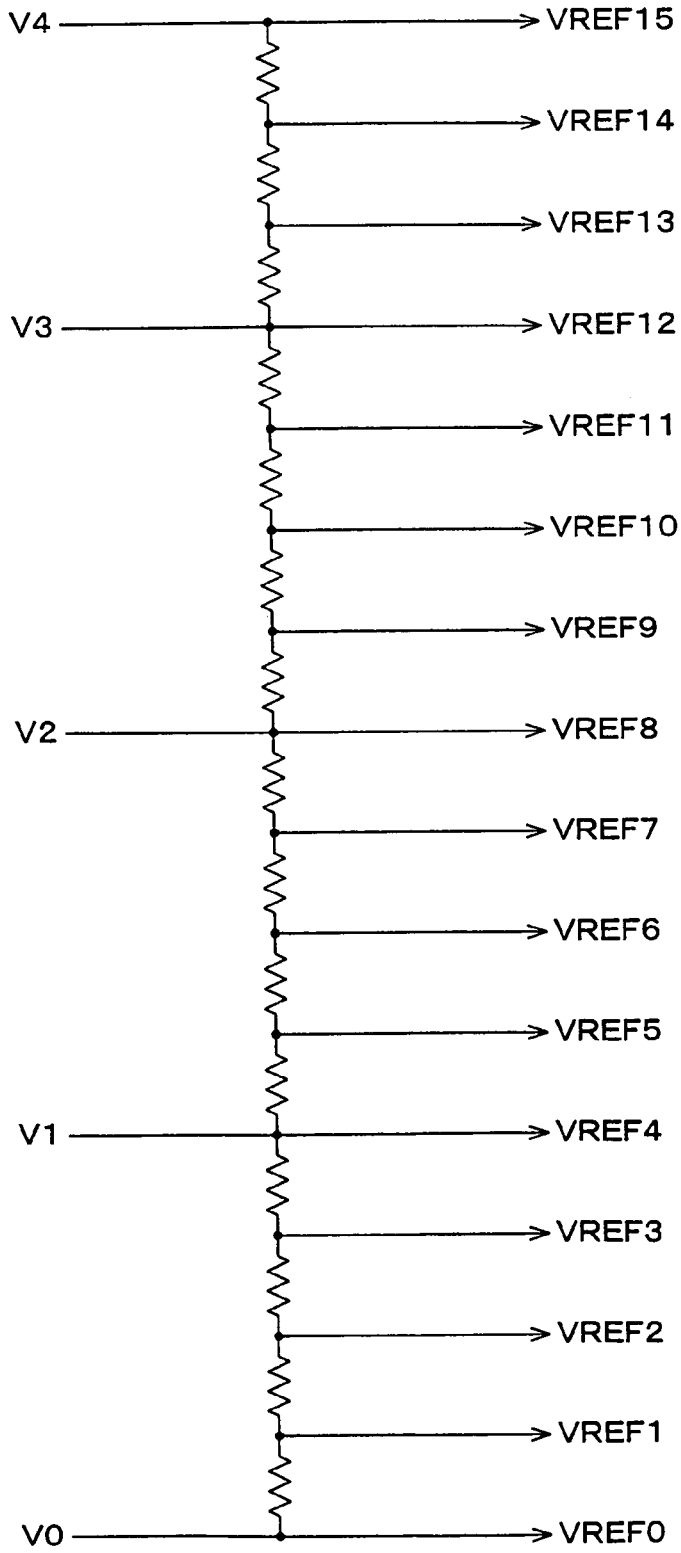
FIG. 16 is a circuit diagram illustrating another example of the generating section of the reference voltage source in the DA converting section.

Here, the plurality of the reference voltage sources VREF may be directly inputted from the outside, but may be generated inside the data signal line drive circuit, for simplifying an external power source circuit. For example, in an example shown in FIG. 15, sixteen levels of the reference power sources can be generated with two external power sources, namely a power source on high voltage side VCC and a power source on low voltage side VEE. Besides, in an example of FIG. 16, five outside power sources V0 to V4 generate the sixteen levels of the reference power sources.

The reference power source generating section like this, when provided on each line of the data signal line drive circuit, may cause a display defect such as stripes in vertical directions, because of the property unevenness and the like. For this reason, it is desirable to provide one reference power source generating section for the whole data signal line drive circuit.

The pseudo tone gradation processing is effective when displaying an image in more tone gradations (many bits) beyond the ability of the output section of the data signal line drive circuit. On the other hand, in such a case where the primary image has a few tone gradations, because it gives no merit, it is desirable not to carry out the pseudo tone gradation processing in both terms of the display quality and the electric power consumption. Further, a usage environment may be a determining factor as to whether the pseudo tone gradation processing is used or not; for example, when the image display apparatus is driven by a battery, the image display apparatus may be driven without the pseudo tone gradation processing, for keeping electric power consumption low.

Figure 17:
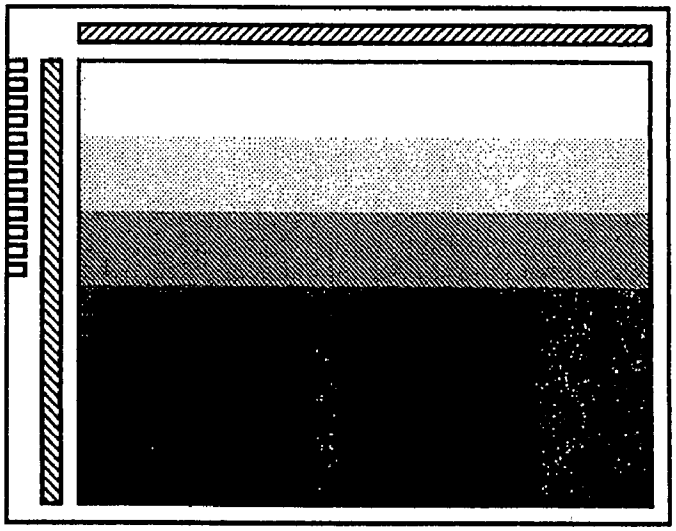
FIG. 17(*a*) is an explanatory diagram illustrating a display on the image display apparatus of the present invention at a time the pseudo tone gradation processing circuit is on, and FIG. 17(*b*) is an explanatory diagram illustrating a display on the image display apparatus of the present invention at a time the pseudo tone gradation processing circuit is off.
Figure 17:
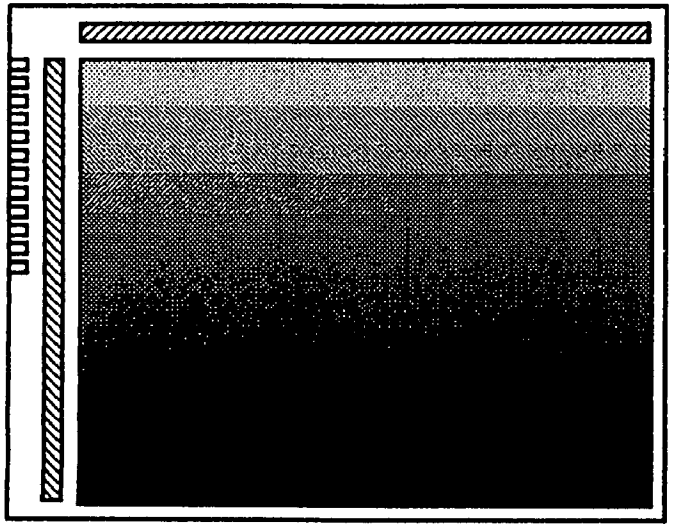

Accordingly, in the image display apparatus in accordance with the present embodiment, it is quite effective to have an arrangement to switch on/off the operation of the pseudo tone gradation processing circuit in terms of the display quality and the electric power consumption. FIG. 17(*a*) is a figure illustrating the image display when the pseudo tone gradation processing circuit is operated, whereas FIG. 17(*b*) is a figure illustrating the image display when the pseudo tone gradation processing circuit is not operated.

Figure 18:
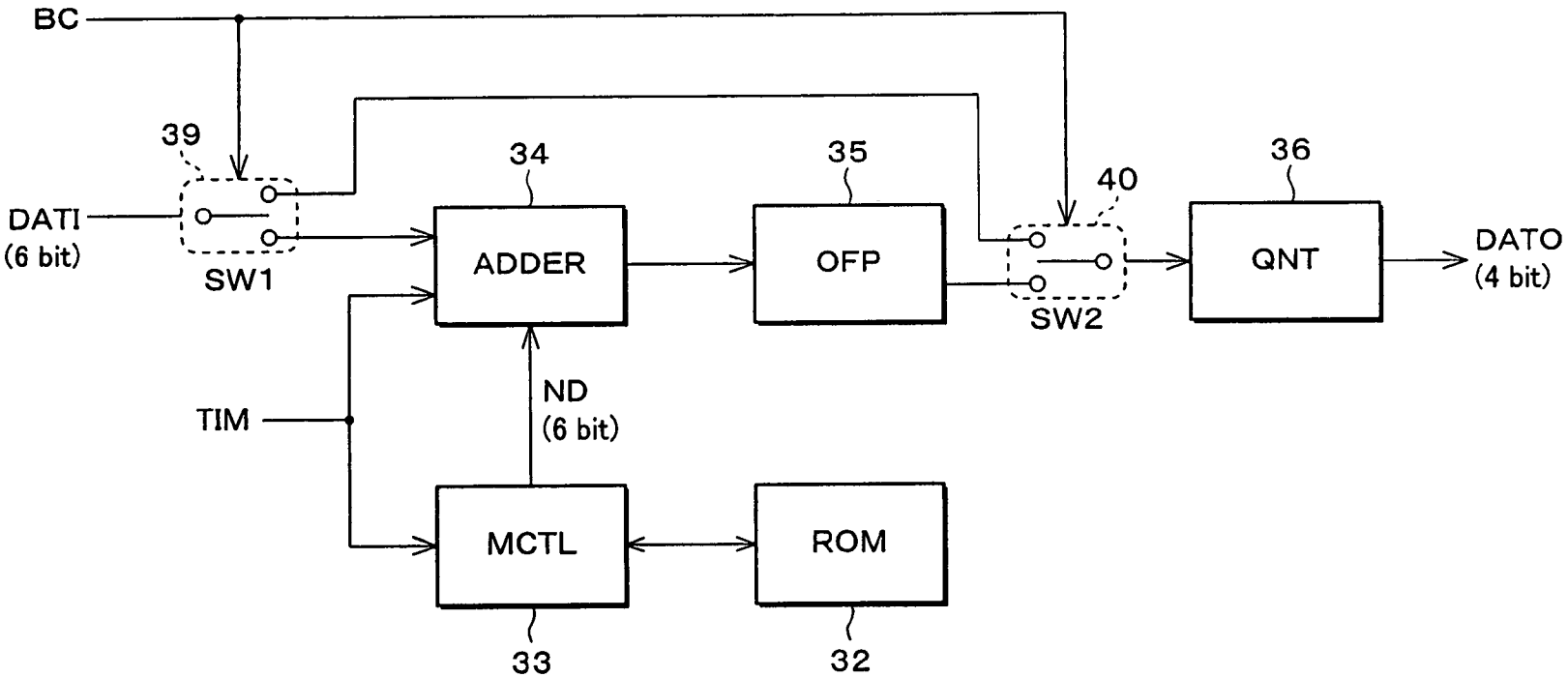
FIG. 18 is a block diagram illustrating an example of the pseudo tone gradation processing circuit that allows switching on/off of the pseudo tone gradation processing in the image display apparatus of the present invention.

Moreover, FIG. 18 is a figure illustrating an arrangement with a function to switch on/off the operation of the pseudo tone gradation processing circuit. In the pseudo tone gradation processing circuit, where a switch 39 before the adder 34 and a switch 40 before the quantization circuit 36 are provided, and the pseudo tone gradation processing circuit is not operated, the adder 34 and the exception processing circuit 35 are bypassed by switching over the switches 39 and 40 in accordance with a control signal BC.

Figure 19:
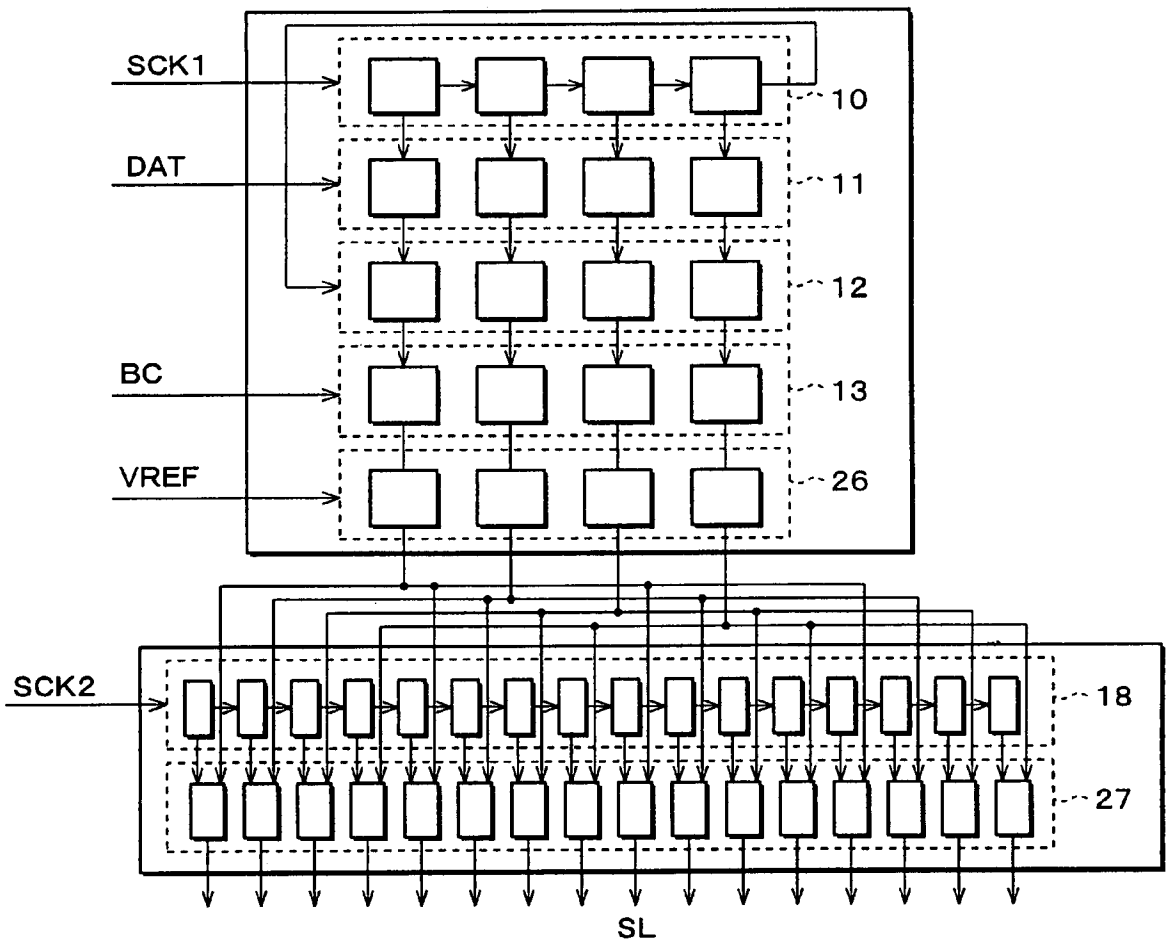
FIG. 19 is a circuit diagram illustrating a further example of the data signal line drive circuit in the image display apparatus of the present invention.
Figure 20:
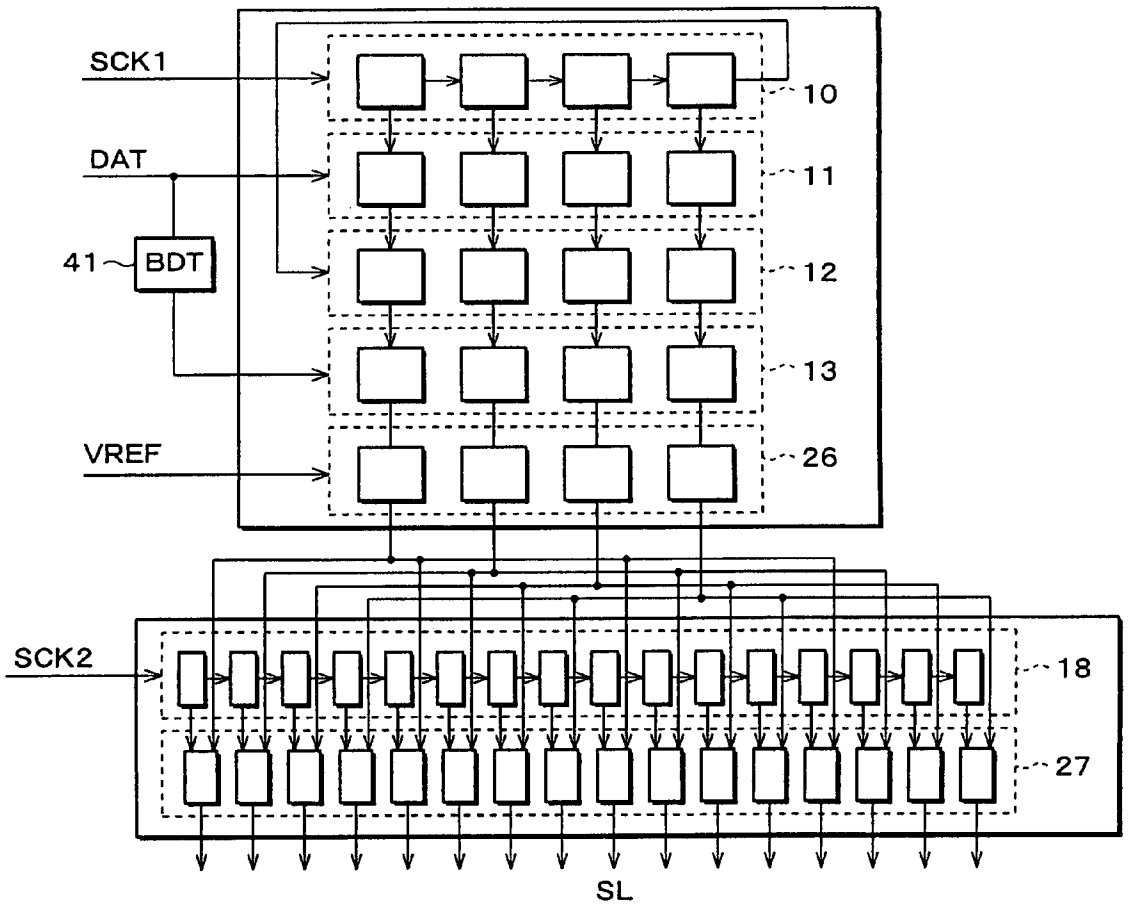
FIG. 20 is a circuit diagram illustrating a still further example of the data signal line drive circuit in the image display apparatus of the present invention.

As for switching over the switches 39 and 40, as in FIG. 19, the switches 39 and 40 may be directly controlled by receiving the control signal BC from the outside, or may be automatically switched over in reference to the video signals DAT, as in FIG. 20.

Namely, as in the arrangement of FIG. 20, when the operation of the pseudo tone gradation processing circuit is automatically switched over in reference to the video signal DAT, for example, a video data monitoring section (BDT) 41 monitors a less significant bit (a bit to be rounded off by the quantization circuit) of the video signal DAT and outputs the control signal for stopping the pseudo tone gradation processing circuit in a next frame if the less significant bit does not include data for one frame period.

The image display apparatus in accordance with the present embodiment as explained above, is effective in such an arrangement in which an active element in the data signal line drive circuit is composed of the polycrystalline silicone thin film transistor.

Figure 21:
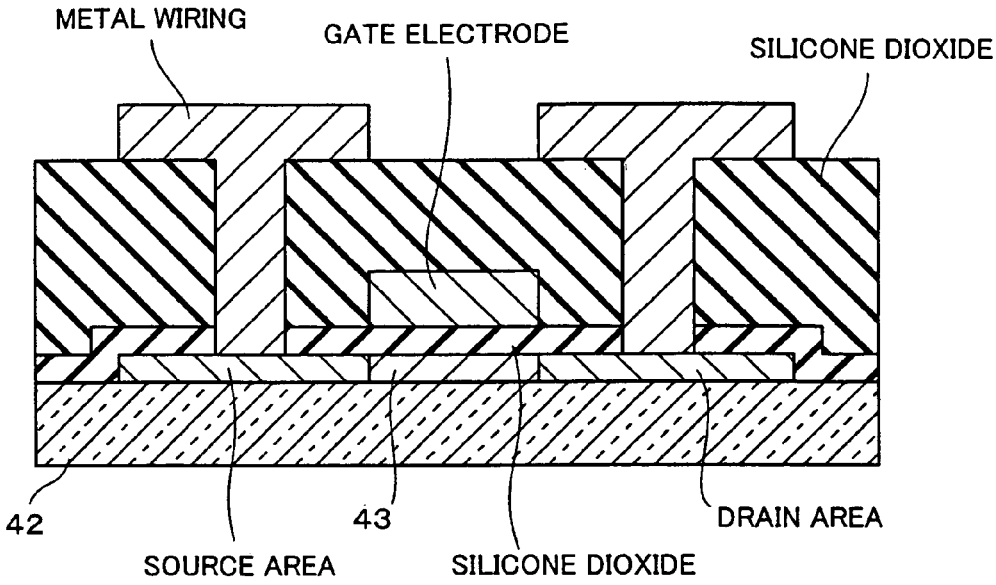
FIG. 21 is a sectional view illustrating a structural example of a polycrystalline silicone thin film transistor that composes the image display apparatus of the present invention.

FIG. 21 shows an example of an arrangement of the polycrystalline silicone thin film transistor used in the image display apparatus. The polycrystalline silicone thin film transistor in FIG. 21 is a sequential stagger (a top gate) structure in which a polycrystalline silicone thin film 43 on an insulation substrate 42 is an active layer. However, the present invention is not limited to this, and may have other structures such as an inverse stagger structure.

By using the polycrystalline silicone thin film transistor as described above, the data signal line drive circuit and the scanning signal line drive circuit having a practical driving ability can be formed on the same substrate as the pixel array in an almost identical manufacturing process.

Moreover, the polycrystalline silicone thin film transistor generally has more property unevenness and suffers from more deterioration with age in comparison to a monocrystalline silicone transistor (an MOS transistor). Furthermore, because of a high drive voltage, a large size and a strict design rule of the element, the polycrystalline silicone thin film transistor occupies a large area and causes a notable increase in electric power consumption, when composed in a complicated structure. For this reason, it is quite advantageous to realize the multiple tone gradation display by using the above-mentioned simple pseudo tone gradation processing circuit.

A manufacturing process for forming the polycrystalline silicone thin film transistor at the temperature of 600° C. or below is briefly explained as follows, referring to FIGS. 22(*a*) through 22(*k*).

Figure 22:
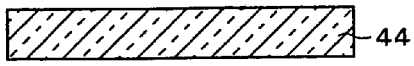
FIGS. 22(*a*) through 22(*k*) are diagrams illustrating an example of a manufacturing process of the polycrystalline silicone thin film transistor shown in FIG. 21.
Figure 22:
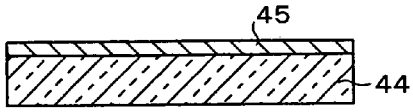
Figure 22:
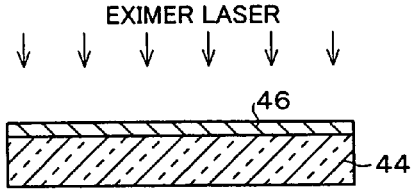
Figure 22:
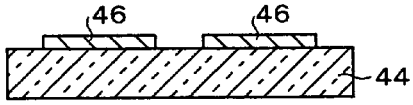
Figure 22:
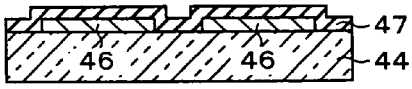
Figure 22:
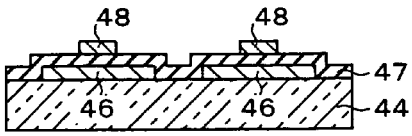
Figure 22:
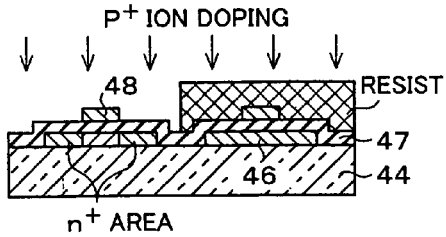
Figure 22:
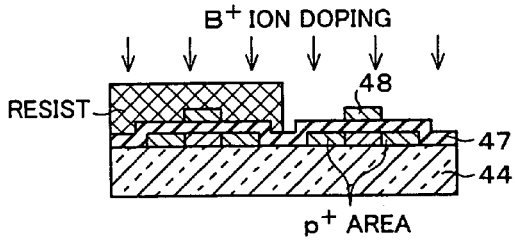
Figure 22:
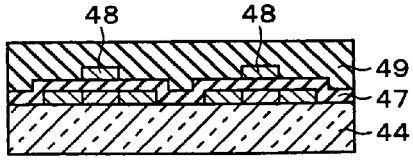
Figure 22:
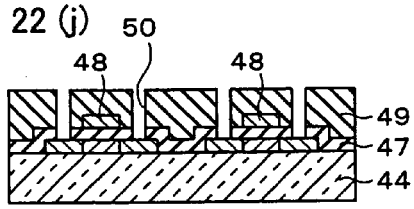
Figure 22:
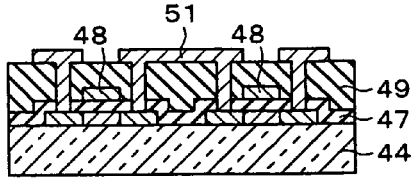
Figure 23:
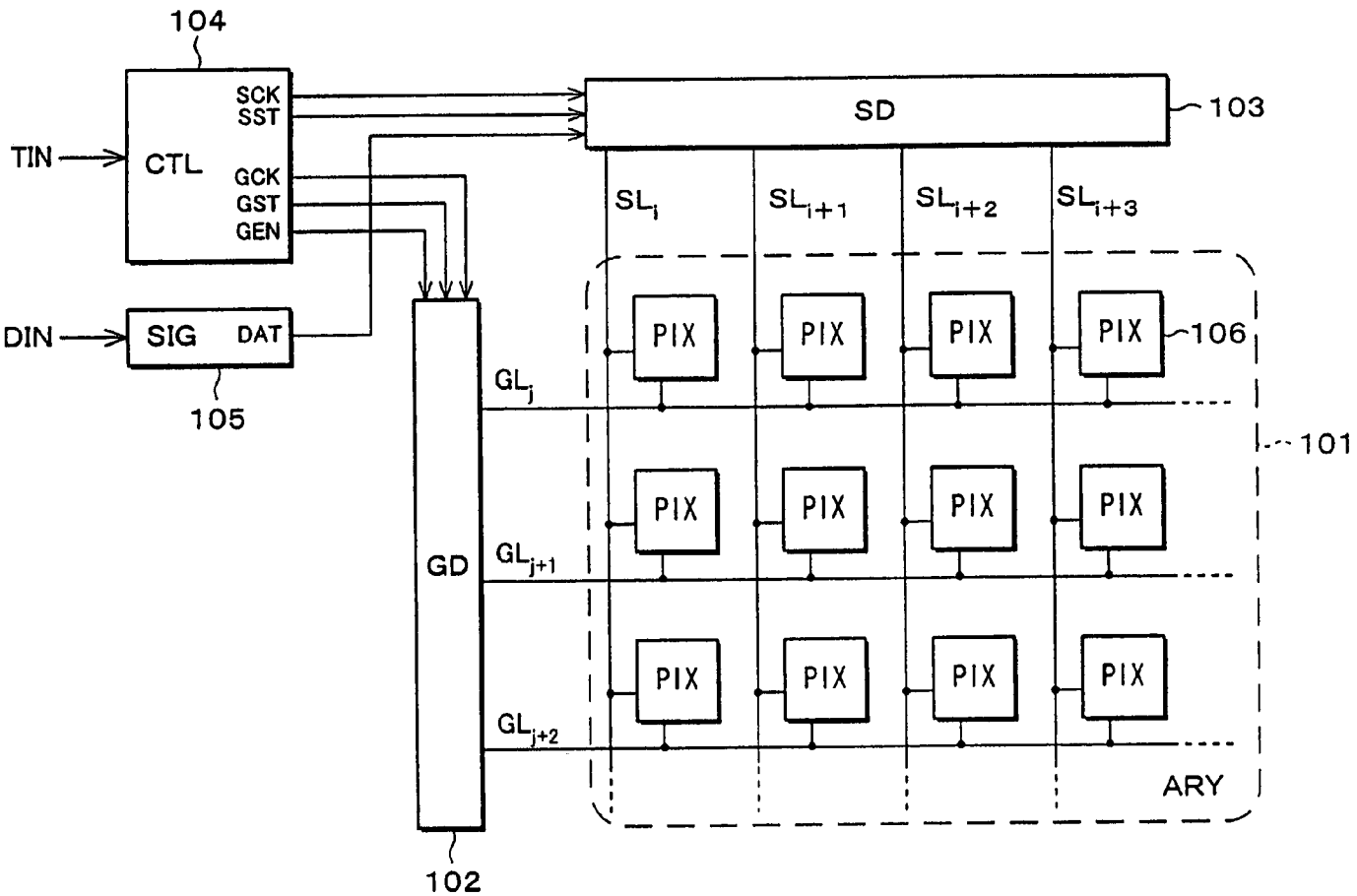
FIG. 23 PRIOR ART
FIG. 23 is a block diagram illustrating an example of an arrangement of a conventional image display apparatus.
Figure 24:
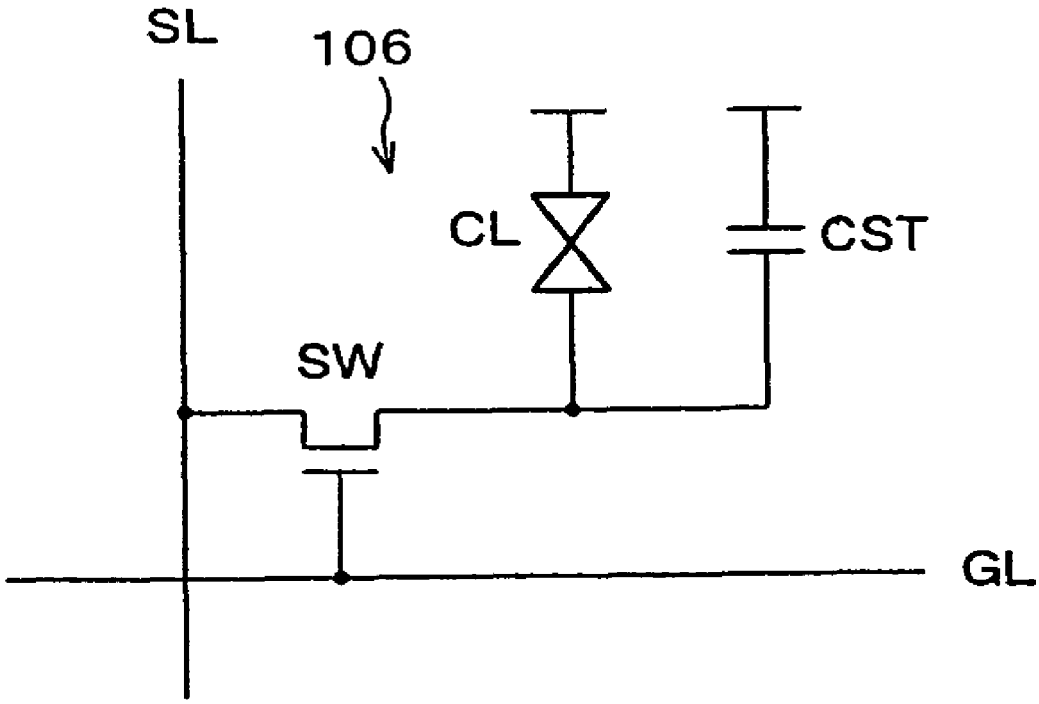
FIG. 24 PRIOR ART
FIG. 24 is a circuit diagram illustrating an internal structure of a pixel in the conventional image display apparatus.
Figure 25:
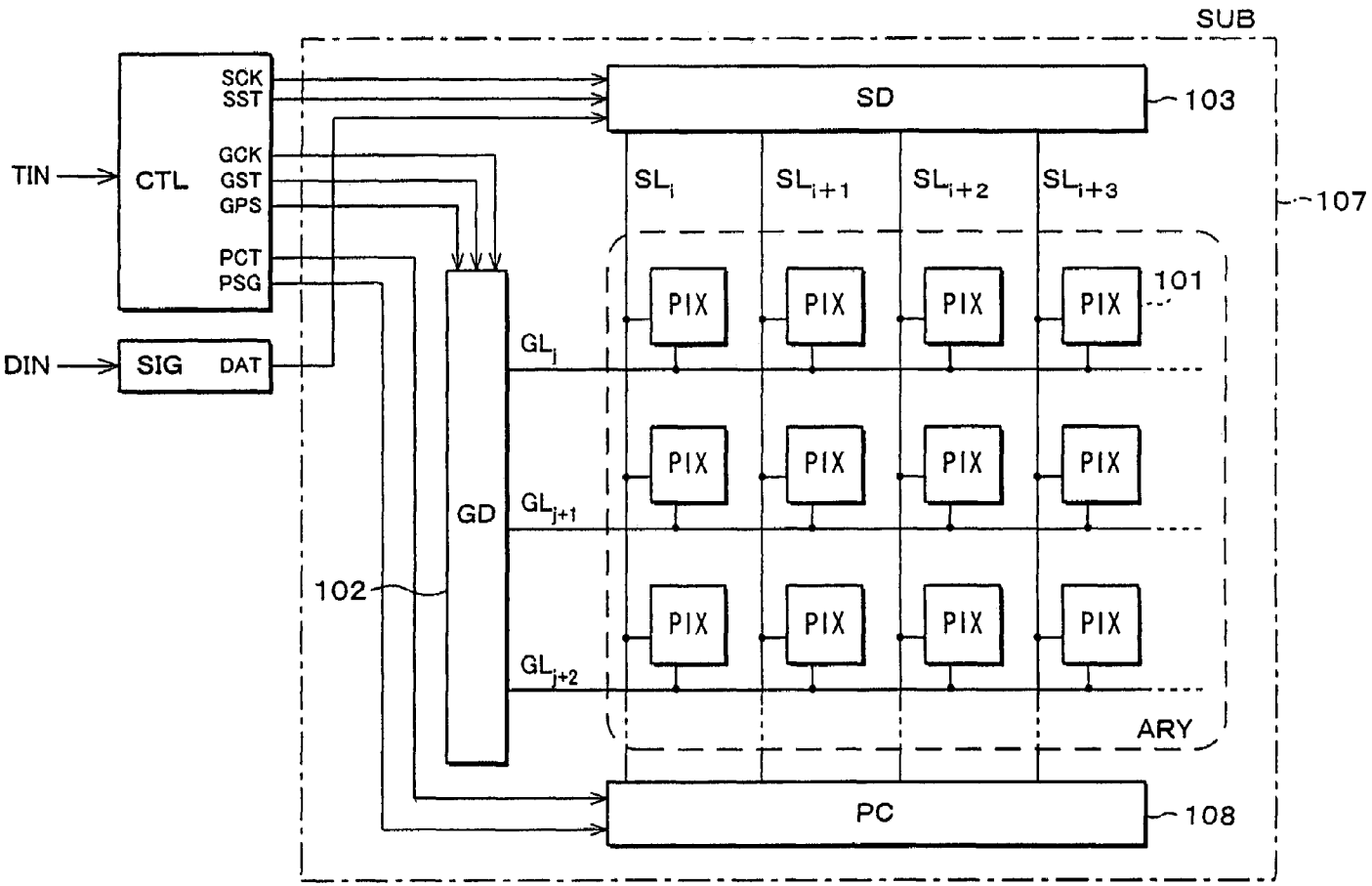
FIG. 25 PRIOR ART
FIG. 25 is a block diagram illustrating an example of an arrangement of the image display apparatus of a drive circuit integrated type, which is a conventional image display apparatus.
Figure 26:
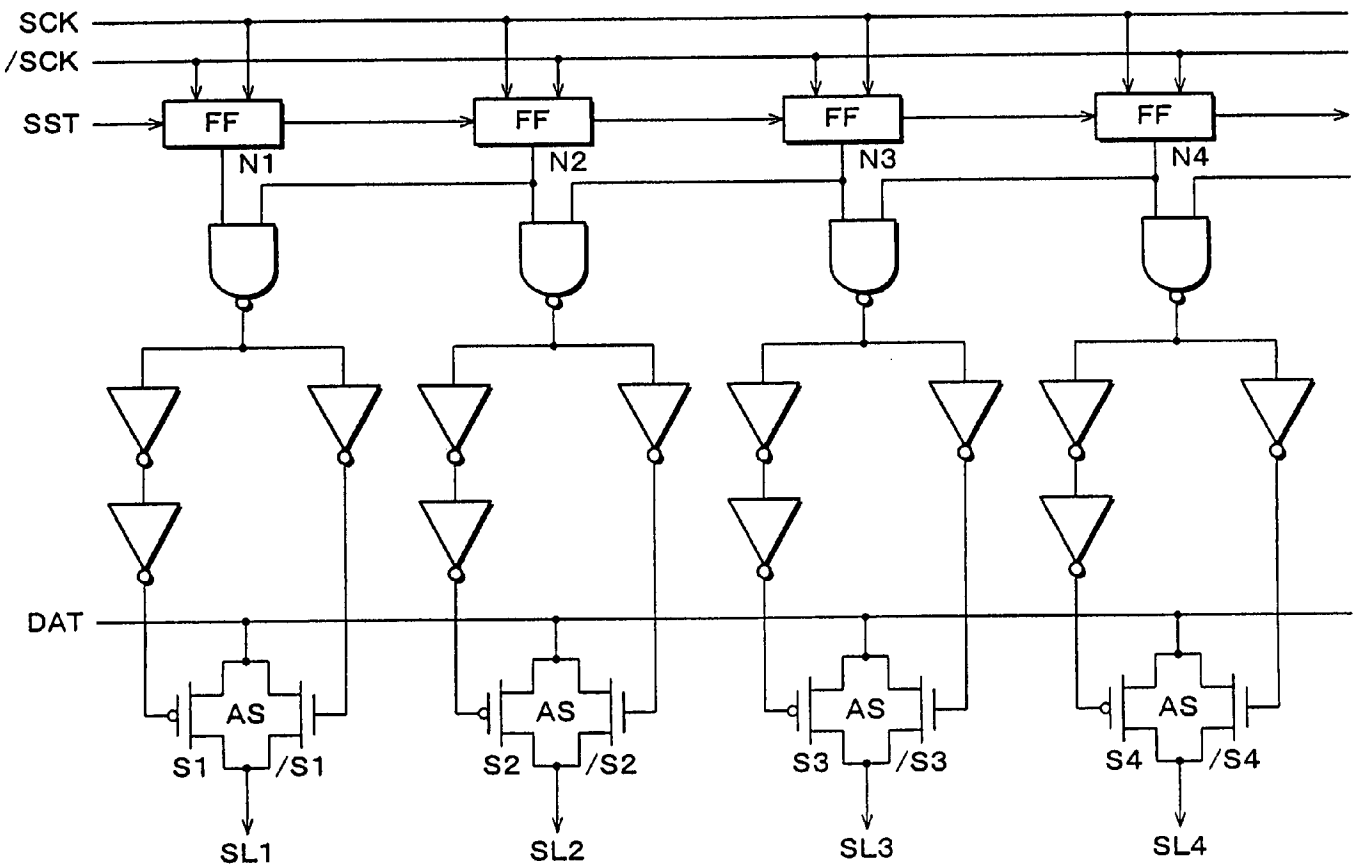
FIG. 26 PRIOR ART
FIG. 26 is a circuit diagram illustrating an example of a conventional data signal line drive circuit that employs an analog point-by-point method.
Figure 27:
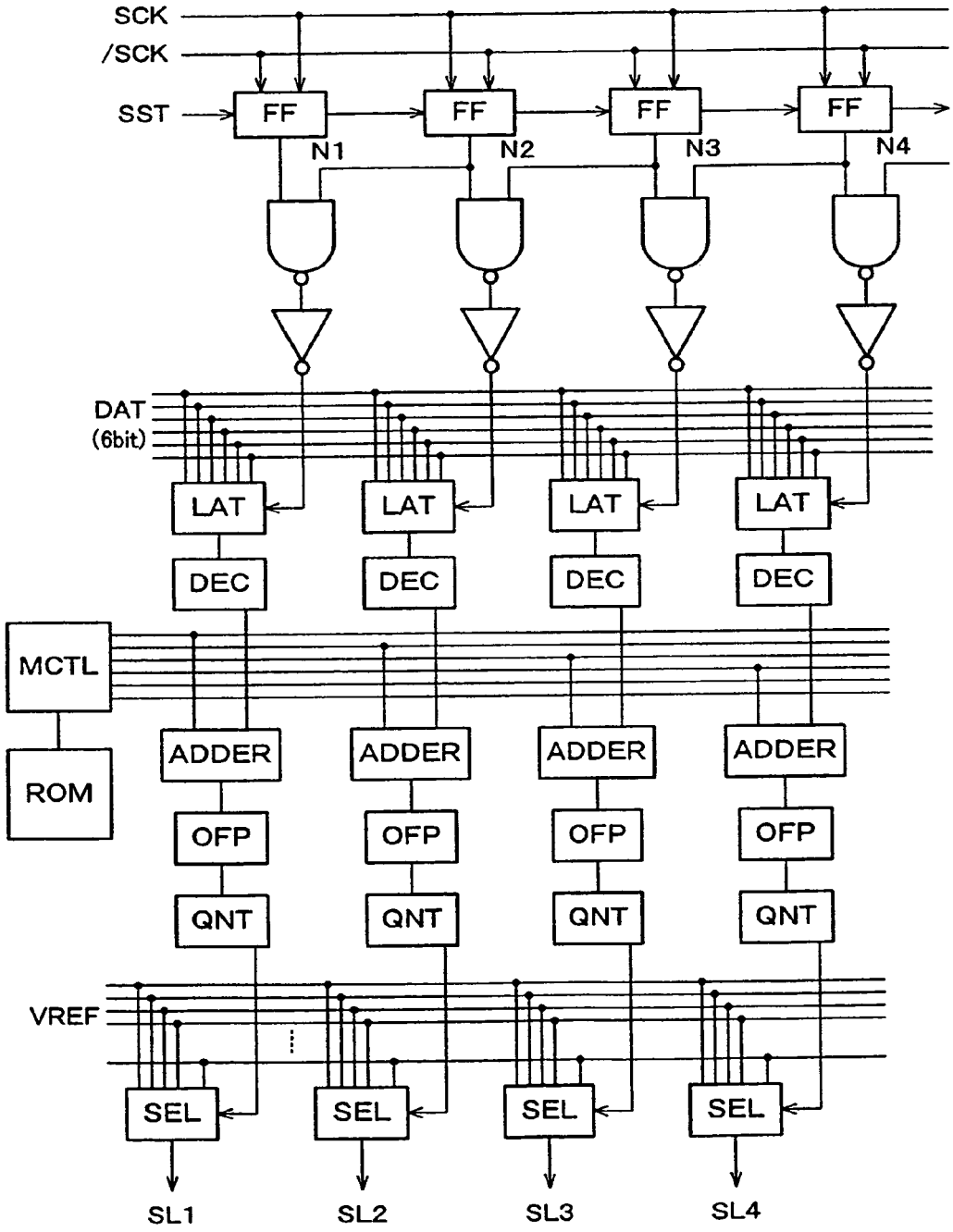
FIG. 27 PRIOR ART
FIG. 27 is a circuit diagram illustrating an example of a conventional data signal line drive circuit that applies the pseudo tone gradation processing.

First, on a glass substrate 44 (see FIG. 22(*a*)), an amorphous silicone thin film 45 is deposited (see FIG. 22(*b*)), which amorphous silicone thin film 45 being then irradiated with eximer laser to form a polycrystalline silicone thin film 46 (see FIG. 22(*c*)).

Next, the polycrystalline silicone thin film 46 is patterned into a desired shape (see FIG. 22(*d*)). Then a gate insulation film 47, which is composed of silicone dioxide, is formed on the patterned polycrystalline silicone film 46 (see FIG. 22(*e*)) Moreover, after a gate electrode 48 of the film transistor is formed with alminium and the like (see FIG. 22(*f*)), impurities (phosphorus for an n-type area, boron for a p-type area) are injected in a source and a drain areas of the film transistor (see FIGS. 22(*g*) through 22(*h*)) Then, after an interlayer insulation film 49, which is composed of the silicone dioxide or silicone nitride and the like, is deposited (see FIG. 22(*i*)) and a contact hole 50 is opened (see FIG. 22 (*j*)), a metal wiring 51 such as alminium is formed (see FIG. 22(*k*)).

In this procedure, since the highest temperature of the process is 600° C. when the gate insulation film is formed, a glass with high heat resistance such as 1737 glass manufactured by U.S. Coning, may be used as the glass substrate 44.

Note that, in the liquid crystal display apparatus, after this procedure, a transparent electrode (in case of the liquid crystal display apparatus of the transparent type) or a reflection electrode (in case of the liquid crystal. display apparatus of a reflection type) is further formed via another interlayer insulation film.

Here, in the manufacturing procedure shown in FIGS. 22(*a*) through 22(*k*), the formation of the polycrystalline silicone thin film transistor at the temperature of 600° C. or below allows the glass substrate of a low price and a large size to be used. This enables the image display apparatus to be lower in price and larger in size.

Note that, the image display apparatus in accordance with the present invention may be applied to the liquid crystal display apparatus, the plasma display apparatus, and the EL display apparatus, but a silicone substrate may be used as its substrate instead of the glass substrate in display apparatus other than the liquid crystal display apparatus of the transparent type. The silicone substrate, however, has several disadvantages such that the silicone substrate costs much higher than the glass substrate, and a 150 to 200 mm diameter (a maximum of 300 mm diameter) of the substrate size can not be applied to a large size of the display apparatus. For this reason, also in the image display apparatus other than the liquid crystal display apparatus of the transparent type, the present invention may be effectively applied for the purpose of cutting down the cost or being applied for the large screen.

As described above, an image display panel, which includes on a substrate (a) a pixel array having a plurality of pixels for displaying an image, and (b) a data signal line drive circuit for supplying video signals to the pixel array, wherein the data signal line drive circuit drives an n number of data signal lines for sending the video signals to the pixels on the pixel array and includes m stages of pseudo tone gradation processing means, for carrying out pseudo tone gradation processing with respect to the video signals that are to be sent respectively to the data signal lines, where m<n, and each of the pseudo tone gradation processing means sends to the data signal lines the video signals subjected to the pseudo tone gradation processing every m lines.

According to the arrangement, the image display panel in which the data signal line drive circuit for driving an n number of the data signal lines is formed on the same substrate as the pixel array, has an m number of the pseudo tone gradation processing means, which is less than the number of the data signal lines (n number), and which are used in common with respect to the video signals to be outputted to a plurality of data signal lines, respectively. This simplifies an arrangement of the data signal line drive circuit, thereby making it possible to display multiple tone gradations by using the simple circuit arrangement so simplified to be able to be applied to the image display panel of the drive circuit integrated type.

In addition, in the pseudo tone gradation processing means, time for performing the pseudo tone gradation process of the video signals for one line is usually longer than time for inputting the video signals for one line. But by outputting the video signals subjected to the pseudo tone gradation processing to the data signal lines every m lines, each pseudo tone gradation processing means is able to obtain the processing time m times as long as the input cycle of the video signals for the pseudo tone gradation processing of the video signals for one line.

Moreover, the image display panel, as a first arrangement, may be so adapted that the data signal line drive circuit includes m stages of first latch means for sequentially latching therein the video signals synchronously to an output of a first shift register, m stages of parallelizing means for parallelizing the video signals latched by the first latch means, and n stages of second latch means for sequentially latching therein the video signals subjected to the pseudo tone gradation processing by the pseudo tone gradation processing means synchronously to an output of a second shift register, wherein each of the pseudo tone gradation processing means carries out the pseudo tone gradation processing with respect to the video signals parallelized by the parallelizing means, and wherein the video signals subjected to the pseudo tone gradation processing by each of the pseudo tone gradation processing means are latched collectively as to m lines of the video signals into the second latch means synchronously to the output of the second shift register having a lower working frequency than the first shift register, and are then sent respectively to the data signal lines.

According to the first arrangement, since each stage of the second shift register deals with a plurality of the data signal lines (m number), a number of the stages of the second shift register can be 1/m of the number of the data signal lines (n number). This allows a scale of the drive circuit to be small. Further, since a frequency of the second shift register becomes 1/m of a frequency of the first shift register, the second latch means can obtain long time for sending data to the data signal lines.

Moreover, the image display panel, as a second arrangement, may be so adapted that the data signal line drive circuit includes m stages of first latch means for sequentially latching therein the video signals synchronously to an output of a first shift register and n stages of second latch means for sequentially latching therein the video signals subjected to the pseudo tone gradation processing by the pseudo tone gradation processing means synchronously to an output of a second shift register, wherein each of the pseudo tone gradation processing means latches therein the video signals from the first latch means in the same cycle as the outputs of the first shift register, and carries out the pseudo tone gradation processing with respect to the video signals, and wherein the video signals subjected to the pseudo tone gradation processing by each of the pseudo tone gradation processing means are latched as to one line of the video signals into the second latch means synchronously to the output of the second shift register having the same working frequency as the first shift register, and are then sent respectively to the data signal lines.

According to the second arrangement, by using a sum of a plurality of output signals from the second shift register, the second latch means can obtain long time for sending data to the data signal lines. Besides, in this arrangement, the same signal as the clock signal that controls the first shift register may be used as the clock signal that controls the second shift register. Therefore, a circuit for generating a new signal is not required. Further, since the sequential output of the data to the data signal lines gives such a merit that block-by-block border (deficiency in display) unlikely occurs, which may be caused in case of collective output of a plurality of data.

Moreover, it is preferable in the image display panel of the first arrangement that the working frequency of the first shift register is integrally multiplied with respect to the working frequency of the second shift register.

According to the arrangement, timing relation between the clock signal that gives the working frequency of the first shift register and the clock signal that gives the working frequency of the second shift register is simplified. This allows the whole structure of the data signal line drive circuit to be simple.

Moreover, it is preferable in the image display panel of the first arrangement that a clock signal for driving the second shift register is generated from an output signal from the last stage of the first shift register.

According to the arrangement, the clock signal for driving the second shift register is not required to be separately inputted from outside of the data signal line drive circuit. This allows the whole structure of the data signal line drive circuit to be simple.

Moreover, the image display panel may be so adapted that digital/analog converting means for converting the digital video signal subjected to the pseudo tone gradation processing by the pseudo tone gradation processing means into an analog video signal, wherein the digital/analog converting means carries out the converting processing after latching by the second latch means.

According to the arrangement, since the video data are latched by the second latch means and then subjected to the conversion processing by the digital/analog converting means, the video data are treated as digital signals until being sent to the data signal lines. For this reason, the video data are less subject to influences of a noise or a subtle timing lag, thereby offering a display of high image quality.

Moreover, the image display panel may be so adapted that digital/analog converting means for converting the digital video signal subjected to the pseudo tone gradation processing by the pseudo tone gradation processing means into an analog video signal, wherein the converting processing by the digital/analog converting means is carried out after the pseudo tone gradation processing by the pseudo tone gradation processing means and before latch by the second latch means.

According to the arrangement, since the video signals are subjected to the conversion processing by the digital/analog converting means after the pseudo tone gradation processing by the pseudo tone gradation processing means and before latch by the second latch means, the digital analog converting means requires m stages same as the pseudo tone gradation processing means. This simplifies the arrangement of the data signal line drive circuit. Further, the circuit structure of the digital/analog converting means can be composed of the shift register, a simple gate such as an inverter and a NAND, and an analog switch. This allows the digital/analog converting means to be very simple and compact.

Moreover, the image display panel may be so adapted that the pseudo tone gradation processing means carries out a superimposing process by adding a signal of a fixed pattern data repeated in a certain cycle on the video signal, and a rounding-off process of rounding off a less significant bit of the superimposed video signal.

According to the arrangement, by repeating the pattern data, which is to be superimposed on the video signal, for the certain cycle, it is possible to reduce the capacity of the memory means for storing the pattern data. Further, the pseudo tone gradation processing can be realized quite easily without complicated arithmetic processing. This can be easily applied to the image display apparatus of the drive circuit integrated type.

Moreover, the image display panel may be so adapted that a width of the fixed pattern data, in an aligned direction of the data signal lines, is equivalent to a number of lines integrally multiplied with respect to m.

According to the arrangement, since the fixed pattern data is repeated for a cycle integrally multiplied with respect to a processing cycle of the pseudo tone gradation processing means (m lines of the data signal lines), each of the pseudo tone gradation processing means is provided with only a part of the fixed pattern data, thereby reducing the capacity of the memory means for storing the fixed pattern data.

Moreover, the image display panel may be so adapted that the pseudo tone gradation processing means includes memory means for storing the fixed pattern data, the memory means (for example, a ROM) in each of the pseudo tone gradation processing means storing only the fixed pattern data for the data signal line respectively corresponding to the pseudo tone gradation processing means.

According to the arrangement, it is possible to minimize the data quantity of the memory means that should be built-in each of the pseudo tone gradation processing means. Further, this also simplifies a structure or a driving method of the memory control circuit that manages the read-out of the fixed pattern data from the memory means.

Moreover, the image display panel may be so adapted that the pseudo tone gradation processing means shifts the fixed pattern data, which is to be superimposed on the video signal, for a certain amount in a horizontal direction per cycle of the fixed pattern data in a vertical direction.

According to the arrangement, this makes difficult to recognize a block-shaped pseudo pattern caused by the fixed pattern data signal superimposed on the video signal, thereby improving the display quality.

Moreover, the image display panel may be so adapted that the pseudo tone gradation processing means shifts the fixed pattern data, which is to be superimposed on the video signal, for a certain amount in a horizontal direction per certain frame cycle.

According to the arrangement, this makes difficult to recognize a block-shaped pseudo pattern caused by the fixed pattern data signal superimposed on the video signal, thereby improving the display quality.

Besides, to shift the fixed pattern data per one frame period is most effective for making the block-shaped pseudo pattern less recognizable because the succession of the identical fixed patterns are the shortest. Note that, when the fixed pattern data is shifted per two frame period, the display quality is improved by making the pseudo pattern less recognizable and degradation of the liquid crystal material is reduced because a DC component of voltage applied on the liquid crystal is canceled corresponding to an AD drive of the liquid crystal, thereby effectively improving reliability of the display apparatus.

Moreover, the image display panel may be so adapted that a pseudo tone gradation processing means shifts the fixed pattern data, which is to be superimposed on the video signal, for an amount of a 1/k (k is an integral number not less than 2) cycle in the horizontal direction per cycle of the fixed pattern data in the vertical direction, or per certain frame cycle.

According to the arrangement, timing control for reading out of the fixed pattern data to be superimposed on the video signal (switching a read-out starting address) becomes easy, thereby simplifying the arrangement of the pseudo tone gradation processing means.

Moreover, the image display panel may be so adapted that the pseudo tone gradation processing means changes, per certain frame cycle, the fixed pattern data that is superimposed on the video signal.

According to the arrangement, when the fixed pattern data to be superimposed on the video signal is shifted in a horizontal direction, movement of the block-shaped pseudo pattern may be recognized. However, by using a completely different fixed pattern data per frame, the block-shaped pseudo pattern becomes further less recognizable, thereby further improving the display quality.

Of course, as to the cycle to shift the fixed pattern data, to shift per one frame period is most effective for making the block-shaped pseudo pattern less recognizable, and to shift per two frame period can improve both of the display quality and the reliability of the display apparatus.

Moreover, the image display panel may be so adapted that the pseudo tone gradation processing means repeats an identical fixed pattern data per certain frame cycle as the fixed pattern data to be superimposed on the video signal.

According to the arrangement, it is possible to limit types of the pattern data, thereby reducing the capacity of the memory means for storing the fixed pattern data.

Moreover, the image display panel may be so adapted that the digital/analog converting means selects one of a plurality of reference voltage sources according to the video signals subjected to the pseudo tone gradation processing.

According to the arrangement, by employing the digital drive method of a selector type that selects one of the plurality of the reference voltage sources, it is possible to display multiple tone gradations in a simple arrangement.

In addition, since each data signal line does not built-in an amplifier, the R-DAC, or the C-DAC, it is possible to avoid display unevenness in a vertical direction caused by the property unevenness. Further, it is possible to reduce electric power consumption because of a lack of a flowing circuit for stationary electric current.

Moreover, the image display panel may be so adapted that the plurality of the reference voltage sources are generated on the substrate by external reference voltage source inputted from outside, where a number of the external reference voltage source inputted from outside is much less than that of the reference voltage source.

According to the arrangement, it is possible to reduce the number of the external reference voltage sources, thereby simplifying the whole arrangement of the data signal line drive circuit. Further, one reference voltage source generating circuit is provided for the whole data signal line drive circuit, not for each data signal line, thereby reducing a display defect such as stripes in vertical directions, because of the property unevenness.

Moreover, the image display panel may be so adapted that the pseudo tone gradation processing means has a function to switch on and off its pseudo tone gradation processing according to a control signal inputted from outside.

According to the arrangement, in case where the image display has small display tone gradations (when the pseudo tone gradation processing is not effective), it is possible to stop the pseudo tone gradation processing circuit, thereby realizing image display in smaller electric power consumption.

Moreover, the image display panel may be so adapted that the pseudo tone gradation processing means has a function to switch on and off its pseudo tone gradation processing according to a control signal inputted from outside.

According to the arrangement, by controlling the operation of the pseudo tone gradation processing means from the outside, it is possible to select the display quality (the display tone gradations) and the electric power consumption in accordance with a display image type, a usage environment, or user's preferences.

Moreover, the image display panel may be so adapted that the pseudo tone gradation processing means has a function to switch on and off its pseudo tone gradation processing in accordance with a bit number of the inputted digital video signal.

According to the arrangement, by controlling the operation of the pseudo tone gradation processing means with digital video signals, it is possible to automatically select the most optimal driving method in terms of the display quality (the display tone gradations) and the electric power consumption in accordance with a display image type (the number of the tone gradations).

Moreover, the image display panel may be so adapted that an active element composing the data signal line drive circuit is composed of a polycrystalline silicone thin film transistor.

According to the arrangement, since pixels for displaying and the data signal line drive circuit for driving the pixels can be manufactured on the same substrate in the same procedure, it is expected to reduce manufacturing and mounting costs and increase a non-defective mounting rate.

Furthermore, when the transistor is formed by using the polycrystalline silicone thin film, in comparison to the amorphous silicone thin film transistor used in the conventional image display apparatus, property of very high drive power can be achieved. For this reason, in addition to the above effects, the pixels and the data signal line drive circuit can be easily formed on the same substrate.

In addition, the polycrystalline silicone thin film transistor has more property unevenness and suffers from more deterioration with age in comparison to a mono-crystalline silicone transistor. For this reason, when composed in the data signal line drive circuit, the amplifier, the R-DAC or the C-DAC may cause a notable degradation in its precision or occupy a larger area, but it is quite advantageous to employ the arrangement of the present invention for improving the display quality.

Moreover, the image display panel may be so adapted that the polycrystalline silicone thin film transistor is formed on glass at a manufacturing temperature not more than 600° C.

According to the arrangement, when the polycrystalline silicone thin film transistor is formed at the processing temperature not more than 600° C., glass can be used as the substrate, because glass is a low cost and easily formed larger in size in spite of its low distortion point temperature. For this reason, it is possible to manufacture the large size of the image display apparatus at a low cost.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. An image display panel, which includes on a substrate (a) a pixel array having a plurality of pixels for displaying an image, and (b) a data signal line drive circuit for supplying video signals to the pixel array, wherein:

the data signal line drive circuit drives an n number of data signal lines for sending the video signals to the pixels on the pixel array and includes m stages of pseudo tone gradation processing means, for carrying out pseudo tone gradation processing to reduce the bit count of the video signals that are to be sent respectively to the data signal lines, where m<n;

each of the pseudo tone gradation processing means sends to the data signal lines the video signals subjected to the pseudo tone gradation processing every m lines, wherein said data signal line drive circuit includes m stages of first latch means, a first shift register, n stages of second latch means and a second shift register, and wherein the video signals subjected to the pseudo tone gradation processing by each of the pseudo tone gradation processing means are latched collectively as to m lines of the video signals into said second latch means synchronously to the output of said second shift register having a lower working frequency than said first shift register, and are then sent respectively to the data signal lines.

2. The image display panel as set forth in claim 1, wherein the data signal line drive circuit includes m stages of parallelizing means for parallelizing the video signals latched by the first latch means; and wherein:

said m stages of first latch means sequentially latch therein the video signals synchronously to an output of said first shift register;

said n stages of second latch means sequentially latch therein the video signals subjected to the pseudo tone gradation processing by the pseudo tone gradation processing means synchronously to an output of said second shift register, and wherein each of the pseudo tone gradation processing means carries out the pseudo tone gradation processing with respect to the video signals parallelized by the parallelizing means.

3. The image display panel as set forth in claim 2, wherein:

the pseudo tone gradation processing means has a function to switch on and off its pseudo tone gradation processing.

4. The image display panel as set forth in claim 3, wherein:

the pseudo tone gradation processing means has a function to switch on and off its pseudo tone gradation processing according to a control signal inputted from outside.

5. The image display panel as set forth in claim 3, wherein:

the pseudo tone gradation processing means has a function to switch on and off its pseudo tone gradation processing in accordance with a bit number of the inputted digital video signal.

6. The image display panel as set forth in claim 2, comprising:

digital/analog converting means for converting the digital video signal subjected to the pseudo tone gradation processing by the pseudo tone gradation processing means into an analog video signal, wherein the converting processing by the digital/analog converting means is carried out after the pseudo tone gradation processing by the pseudo tone gradation processing means and before latch by the second latch means.

7. The image display panel as set forth in claim 6, wherein:

the digital/analog converting means selects one of a plurality of reference voltage sources according to the video signals subjected to the pseudo tone gradation processing.

8. The image display panel as set forth in claim 7, wherein:

the plurality of the reference voltage sources are generated on the substrate by external reference voltage source inputted from outside, where a number of the external reference voltage source inputted from outside is much less than that of the reference voltage source.

9. The image display panel as set forth in claim 2, wherein:

an active element composing the data signal line drive circuit is composed of a polycrystalline silicone thin film transistor.

10. The image display panel as set forth in claim 9, wherein:

the polycrystalline silicone thin film transistor is formed on glass at a manufacturing temperature not more than 600° C.

11. An image display panel as set forth in claim 2, further comprising:

digital/analog converting means for converting the digital video signal subjected to the pseudo tone gradation processing by the pseudo tone gradation processing means into an analog video signal, wherein the digital/analog converting means carries out the converting processing after latching by the second latch means.

12. The image display panel as set forth in claim 11, wherein:

the digital/analog converting means selects one of a plurality of reference voltage sources according to the video signals subjected to the pseudo tone gradation processing.

13. The image display panel as set forth in claim 12, wherein:

the plurality of the reference voltage sources are generated on the substrate by external reference voltage source inputted from outside, where a number of the external reference voltage source inputted from outside is much less than that of the reference voltage source.

14. The image display panel as set forth in claim 2, wherein:

the pseudo tone gradation processing means carries out a superimposing process by adding a signal of a fixed pattern data repeated in a certain cycle on the video signal, and a rounding-off process of rounding off a less significant bit of the superimposed video signal.

15. The image display panel as set forth in claim 14, wherein:

the pseudo tone gradation processing means shifts the fixed pattern data, which is to be superimposed on the video signal, for a certain amount in a horizontal direction per cycle of the fixed pattern data in a vertical direction.

16. The image display panel as set forth in claim 14, wherein:

the pseudo tone gradation processing means shifts the fixed pattern data, which is to be superimposed on the video signal, for a certain amount in a horizontal direction per certain frame cycle.

17. The image display panel as set forth in claim 6, wherein:

the pseudo tone gradation processing means changes, per certain frame cycle, the fixed pattern data that is superimposed on the video signal.

18. The image display panel as set forth in claim 17, wherein:

the pseudo tone gradation processing means repeats an identical fixed pattern data per certain frame cycle as the fixed pattern data to be superimposed on the video signal.

19. The image display panel as set forth in claim 14, wherein:

a width of the fixed pattern data, in an aligned direction of the data signal lines, is equivalent to a number of lines integrally multiplied with respect to m.

20. The image display panel as set forth in claim 19, wherein:

the pseudo tone gradation processing means includes memory means for storing the fixed pattern data, the memory means in each of the pseudo tone gradation processing means storing only the fixed pattern data for the data signal line respectively corresponding to the pseudo tone gradation processing means.

21. The image display panel as set forth in claim 2, wherein:

the working frequency of the first shift register is integrally multiplied with respect to the working frequency of the second shift register.

22. The image display panel as set forth in claim 21, wherein:

a clock signal for driving the second shift register is generated from an output signal from the last stage of the first shift register.

23. The image display panel as set forth in claim 1, wherein the data signal line drive circuit includes:

m stages of first latch means for sequentially latching therein the video signals synchronously to an output of a first shift register; and n stages of second latch means for sequentially latching therein the video signals subjected to the pseudo tone gradation processing by the pseudo tone gradation processing means synchronously to an output of a second shift register, wherein each of the pseudo tone gradation processing means latches therein the video signals from the first latch means in the same cycle as the outputs of the first shift register, and carries out the pseudo tone gradation processing with respect to the video signals, and wherein the video signals subjected to the pseudo tone gradation processing by each of the pseudo tone gradation processing means are latched as to one line of the video signals into the second latch means synchronously to the output of the second shift register having the same working frequency as the first shift register, and are then sent respectively to the data signal lines.

24. The image display panel as set forth in claim 23, wherein:

the pseudo tone gradation processing means has a function to switch on and off its pseudo tone gradation processing.

25. The image display panel as set forth in claim 24, wherein:

the pseudo tone gradation processing means has a function to switch on and off its pseudo tone gradation processing in accordance with a bit number of the inputted digital video signal.

26. The image display panel as set forth in claim 24, wherein:

the pseudo tone gradation processing means has a function to switch on and off its pseudo tone gradation processing according to a control signal inputted from outside.

27. The image display panel as set forth in claim 23, comprising:

digital/analog converting means for converting the digital video signal subjected to the pseudo tone gradation processing by the pseudo tone gradation processing means into an analog video signal, wherein the converting processing by the digital/analog converting means is carried out after the pseudo tone gradation processing by the pseudo tone gradation processing means and before latch by the second latch means.

28. The image display panel as set forth in claim 27, wherein:

the digital/analog converting means selects one of a plurality of reference voltage sources according to the video signals subjected to the pseudo tone gradation processing.

29. The image display panel as set forth in claim 28, wherein:

the plurality of the reference voltage sources are generated on the substrate by external reference voltage source inputted from outside, where a number of the external reference voltage source inputted from outside is much less than that of the reference voltage source.

30. An image display panel as set forth in claim 23, further comprising:

digital/analog converting means for converting the digital video signal subjected to the pseudo tone gradation processing by the pseudo tone gradation processing means into an analog video signal, wherein the digital/analog converting means carries out the converting processing after latching by the second latch means.

31. The image display panel as set forth in claim 23, wherein:

an active element composing the data signal line drive circuit is composed of a polycrystalline silicone thin film transistor.

32. The image display panel as set forth in claim 31, wherein:

the polycrystalline silicone thin film transistor is formed on glass at a manufacturing temperature not more than 600° C.

33. The image display panel as set forth in claim 30, wherein:

the digital/analog converting means selects one of a plurality of reference voltage sources according to the video signals subjected to the pseudo tone gradation processing.

34. The image display panel as set forth in claim 33, wherein:

the plurality of the reference voltage sources are generated on the substrate by external reference voltage source inputted from outside, where a number of the external reference voltage source inputted from outside is much less than that of the reference voltage source.

35. The image display panel as set forth in claim 23, wherein:

the pseudo tone gradation processing means carries out a superimposing process by adding a signal of a fixed pattern data repeated in a certain cycle on the video signal, and a rounding-off process of rounding off a less significant bit of the superimposed video signal.

36. The image display panel as set forth in claim 35, wherein:

the pseudo tone gradation processing means changes, per certain frame cycle, the fixed pattern data that is superimposed on the video signal.

37. The image display panel as set forth in claim 36, wherein:

the pseudo tone gradation processing means repeats an identical fixed pattern data per certain frame cycle as the fixed pattern data to be superimposed on the video signal.

38. The image display panel as set forth in claim 35, wherein:

a width of the fixed pattern data, in an aligned direction of the data signal lines, is equivalent to a number of lines integrally multiplied with respect to m.

39. The image display panel as set forth in claim 38, wherein:

the pseudo tone gradation processing means includes memory means for storing the fixed pattern data, the memory means in each of the pseudo tone gradation processing means storing only the fixed pattern data for the data signal line respectively corresponding to the pseudo tone gradation processing means.

40. The image display panel as set forth in claim 35, wherein:

the pseudo tone gradation processing means shifts the fixed pattern data, which is to be superimposed on the video signal, for a certain amount in a horizontal direction per cycle of the fixed pattern data in a vertical direction.

41. The image display panel as set forth in claim 35, wherein:

the pseudo tone gradation processing means shifts the fixed pattern data, which is to be superimposed on the video signal, for a certain amount in a horizontal direction per certain frame cycle.

42. The image display panel as set forth in claim 1, wherein:

the pseudo tone gradation processing means carries out a superimposing process by adding a signal of a fixed pattern data repeated in a certain cycle on the video signal, and a rounding-off process of rounding off a less significant bit of the superimposed video signal.

43. The image display panel as set forth in claim 42, wherein:

the pseudo tone gradation processing means shifts the fixed pattern data, which is to be superimposed on the video signal, for a certain amount in a horizontal direction per cycle of the fixed pattern data in a vertical direction.

44. The image display panel as set forth in claim 43, wherein:

a pseudo tone gradation processing means shifts the fixed pattern data, which is to be superimposed on the video signal, for an amount of a 1/k (k is an integral number not less than 2) cycle in the horizontal direction per cycle of the fixed pattern data in the vertical direction, or per certain frame cycle.

45. The image display panel as set forth in claim 42, wherein:

the pseudo tone gradation processing means changes, per certain frame cycle, the fixed pattern data that is superimposed on the video signal.

46. The image display panel as set forth in claim 45, wherein:

the pseudo tone gradation processing means repeats an identical fixed pattern data per certain frame cycle as the fixed pattern data to be superimposed on the video signal.

47. The image display panel as set forth in claim 42, wherein:

a width of the fixed pattern data, in an aligned direction of the data signal lines, is equivalent to a number of lines integrally multiplied with respect to m.

48. The image display panel as set forth in claim 47, wherein:

the pseudo tone gradation processing means includes memory means for storing the fixed pattern data, the memory means in each of the pseudo tone gradation processing means storing only the fixed pattern data for the data signal line respectively corresponding to the pseudo tone gradation processing means.

49. The image display panel as set forth in claim 42, wherein:

the pseudo tone gradation processing means shifts the fixed pattern data, which is to be superimposed on the video signal, for a certain amount in a horizontal direction per certain frame cycle.

50. The image display panel as set forth in claim 49, wherein:

a pseudo tone gradation processing means shifts the fixed pattern data, which is to be superimposed on the video signal, for an amount of a 1/k (k is an integral number not less than 2) cycle in the horizontal direction per cycle of the fixed pattern data in the vertical direction, or per certain frame cycle.

51. The image display panel as set forth in claim 1, wherein:

the pseudo tone gradation processing means has a function to switch on and off its pseudo tone gradation processing.

52. The image display panel as set forth in claim 51, wherein:

the pseudo tone gradation processing means has a function to switch on and off its pseudo tone gradation processing according to a control signal inputted from outside.

53. The image display panel as set forth in claim 51, wherein:

the pseudo tone gradation processing means has a function to switch on and off its pseudo tone gradation processing in accordance with a bit number of the inputted digital video signal.

54. The image display panel as set forth in claim 1, wherein:

an active element composing the data signal-line drive circuit is composed of a polycrystalline silicone thin film transistor.

55. The image display panel as set forth in claim 54, wherein:

the polycrystalline silicone thin film transistor is formed on glass at a manufacturing temperature not more than 600° C.

56. An image display apparatus, which includes on a substrate (a) a pixel array having a plurality of pixels for displaying an image, and (b) a data signal line drive circuit for supplying video signals to the pixel array, wherein the image display panel includes:

the data signal line drive circuit for driving an n number of data signal lines for sending the video signals to the pixels on the pixel array; and m stages of pseudo tone gradation processing means for carrying out pseudo tone gradation processing to reduce the bit count of the video signals that are to be sent respectively to the data signal lines, where m<n, wherein each of the pseudo tone gradation processing means sends to the data signal lines the video signals subjected to the pseudo tone gradation processing every m lines, wherein said data signal line drive circuit includes m stages of first latch means, a first shift register, n stages of second latch means and a second shift register, and wherein the video signals subjected to the pseudo tone gradation processing by each of the pseudo tone gradation processing means are latched collectively as to m lines of the video signals into said second latch means synchronously to the output of said second shift register having a lower working frequency than said first shift register, and are then sent respectively to the data signal lines.

57. The image display apparatus as set forth in claim 56, wherein the data signal line drive circuit includes:

m stages of first latch means for sequentially latching therein the video signals synchronously to an output of a first shift register;

m stages of parallelizing means for parallelizing the video signals latched by the first latch means; and n stages of second latch means for sequentially latching therein the video signals subjected to the pseudo tone gradation processing by the pseudo tone gradation processing means synchronously to an output of a second shift register, wherein each of the pseudo tone gradation processing means carries out the pseudo tone gradation processing with respect to the video signals parallelized by the parallelizing means, and wherein the video signals subjected to the pseudo tone gradation processing by each of the pseudo tone gradation processing means are latched. collectively as to m lines of the video signals into the second latch means synchronously to the output of the second shift register having a lower working frequency than the first shift register, and are then sent respectively to the data signal lines.

58. The image display apparatus as set forth in claim 56, wherein the data signal line drive circuit includes:

m stages of first latch means for sequentially latching therein the video signals synchronously to an output of a first shift register; and n stages of second latch means for sequentially latching therein the video signals subjected to the pseudo tone gradation processing by the pseudo tone gradation processing means synchronously to an output of a second shift register, wherein each of the pseudo tone gradation processing means larches therein the video signals from the first latch means in the same cycle as the outputs of the first shift register, and carries out the pseudo tone gradation processing with respect to the video signals, and wherein the video signals subjected to the pseudo tone gradation processing by each of the pseudo tone gradation processing means are latched as to one line of the video signals into the second latch means synchronously to the output of the second shift register having the same working frequency as the first shift register, and are then sent respectively to the data signal lines.

59. An image display method for use in an image display panel, which has on a substrate (a) a pixel array including a plurality of pixels for displaying an image, and (b) a data signal line drive circuit for driving an n number of data signal lines that send video signals to the pixels on the pixel array and supplying the video signals to the pixel array, the image display method comprising the steps of:

carrying out pseudo tone gradation processing to reduce the bit count of the video signals to be sent respectively to the data signal lines, every m lines of the data signal lines by using identical pseudo tone gradation processing means; and outputting the video signals subjected to the pseudo tone gradation processing to the data signal lines every m lines, wherein said data signal line drive circuit includes in stages of first latch means, a first shift register, n stages of second latch means and a second shift register, and wherein the video signals subjected to the pseudo tone gradation processing by each of the pseudo tone gradation processing means are latched collectively as to m lines of the video signals into said second latch means synchronously to the output of said second shift register having a lower working frequency than said first shift register, and are then sent respectively to the data signal lines.

* * * * *